US006170443B1

(12) United States Patent
Hofbauer

(10) Patent No.: US 6,170,443 B1
(45) Date of Patent: Jan. 9, 2001

(54) INTERNAL COMBUSTION ENGINE WITH A SINGLE CRANKSHAFT AND HAVING OPPOSED CYLINDERS WITH OPPOSED PISTONS

(75) Inventor: Peter Hofbauer, Santa Barbara, CA (US)

(73) Assignee: Edward Mayer Halimi, Santa Barbara, CA (US); a part interest ( * ) Notice: Under 35 U.S.C. 154(b), the term of this patent shall be extended for 0 days.

(21) Appl. No.: 09/234,732

(22) Filed: Jan. 21, 1999

Related U.S. Application Data

(60) Provisional application No. 60/100,024, filed on Sep. 11, 1998.

(51) Int. Cl.[7] ..... F02B 25/08

(52) U.S. Cl. ..... 123/51 B; 123/51 BC

(58) Field of Search ..... 123/51 R, 51 B, 123/51 BC, 51 BD, 55.7, 192.1

(56) References Cited

U.S. PATENT DOCUMENTS

| | | | |
|---|---|---|---|
| 1,639,334 | | 8/1927 | Ford . |
| 1,875,838 | | 9/1932 | Winckler . |
| 2,041,708 | | 5/1936 | Harper . |
| 3,485,221 | | 12/1969 | Feeback . |
| 3,895,620 | | 7/1975 | Foster . |
| 4,248,183 | | 2/1981 | Noguchi et al. . |
| 4,254,745 | | 3/1981 | Noguchi et al. . |
| 4,257,365 | | 3/1981 | Noguchi et al. . |
| 4,258,669 | | 3/1981 | Noguchi et al. . |
| 4,305,349 | * | 12/1981 | Zimmerly ..... 123/51 B |
| 4,429,668 | | 2/1984 | Nakagawa et al. . |
| 4,480,597 | | 11/1984 | Noguchi et al. . |
| 4,485,768 | | 12/1984 | Heniges . |
| 4,491,096 | | 1/1985 | Noguchi et al. . |
| 4,565,165 | | 1/1986 | Papanicolaou . |
| 4,694,785 | | 9/1987 | Timmerman et al. . |
| 4,864,976 | | 9/1989 | Falero . |
| 4,974,556 | | 12/1990 | Royse . |
| 5,115,725 | | 5/1992 | Horiuchi . |
| 5,163,388 | | 11/1992 | Jonsson . |
| 5,406,911 | | 4/1995 | Hefley . |
| 5,413,074 | | 5/1995 | Horiuchi . |
| 5,421,293 | | 6/1995 | Noltemeyer et al. . |
| 5,427,067 | | 6/1995 | Horiuchi . |
| 5,476,074 | | 12/1995 | Boggs et al. . |
| 5,479,894 | | 1/1996 | Noltemeyer et al. . |
| 5,560,327 | | 10/1996 | Brackett . |
| 5,586,540 | | 12/1996 | Marzec et al. . |
| 5,794,582 | | 8/1998 | Horiuchi . |

FOREIGN PATENT DOCUMENTS

| | | |
|---|---|---|
| 19503443 C1 | 5/1996 | (DE) . |

OTHER PUBLICATIONS

Sass, Friedrich Dr.–Ing. Dr. –Ing. "Geschichte des Deutschen Verbrennungsmotorenbaues von 1860 bis 1918" 1962 Springer–Verlag Berlin p. 306 This may be closest prior art.

* cited by examiner

*Primary Examiner*—John Kwon
(74) *Attorney, Agent, or Firm*—Gene W. Arant; Larry D. Baker

(57) ABSTRACT

A two-stroke internal combustion engine is disclosed having opposed cylinders, each cylinder having a pair of opposed pistons, with all the pistons connected to a common central crankshaft. The inboard pistons of each cylinder are connected to the crankshaft with pushrods and the outboard pistons are connected to the crankshaft with pullrods. This configuration results in a compact engine with a very low profile, in which the free mass forces can be essentially totally balanced. The engine configuration also allows for asymmetrical timing of the intake and exhaust ports through independent angular positioning of the eccentrics on the crankshaft, making the engine suitable for supercharging.

26 Claims, 21 Drawing Sheets

(b) Right Cylinder (a) Left Cylinder

Section A-A

INTERNAL COMBUSTION ENGINE WITH A SINGLE CRANKSHAFT AND HAVING OPPOSED CYLINDERS WITH OPPOSED PISTONS

RELATED APPLICATION

This application discloses and claims subject matter that is disclosed in applicant's copending provisional U.S. patent application Ser. No. 60/100024 that was filed Sep. 11, 1998.

FIELD OF THE INVENTION

The present invention relates generally to two-stroke internal combustion engines, and more specifically to a two-stroke internal combustion engine having two opposed cylinders, each cylinder having a pair of opposed pistons.

BACKGROUND OF THE INVENTION

1. Introduction

The design and production of internal combustion engines for the automotive and light aircraft industries are well-developed fields of technology. To be commercially viable, any new engine configuration must, without sacrificing performance, provide significant improvements in the areas of energy and raw material conservation (especially the improvement of fuel consumption), environmental protection and pollution control, passenger safety and comfort, and competitive design and production methods that reduce cost and weight. An improvement in one of these areas at the expense of any other is commercially unacceptable.

A new engine configuration must be mechanically simple so that mechanical losses are inherently minimized, and must be well-suited to maximizing combustion efficiencies and reducing raw emissions. In particular, a new engine configuration should specifically address the most significant sources of friction in internal combustion engines to reduce mechanical losses; should have combustion chambers of a volume and design suitable for optimum combustion efficiency; and should be adaptable to utilizing advanced supercharging and direct fuel injection techniques.

A new engine configuration should be lighter in weight and preferably have a reduced height profile for improved installation suitability and passenger safety. For automotive applications, a reduced height profile would permit the engine to fit under the seat or floor area. For light aircraft applications, a short profile would permit installation of the engine directly within the wing, without the need for an engine cowling.

A new engine configuration should be dynamically balanced so as to minimize noise and vibration. Ideally, the smallest practical implementation of the engine, such as a two-cylinder version, should be fully balanced; larger engines could then be constructed by coupling smaller engines together. At low-load conditions, entire portions of the engine (and their associated mechanical losses) could then be decoupled without unbalancing the engine.

2. Description of the Prior Art

Despite the promise of external continuous combustion technologies such as Stirling engines and fuel cells to eventually provide low-emission high-efficiency engines for automobiles and light aircraft, these technologies will not be viable alternatives to internal combustion engines in the near future due to their inherent disadvantages in weight, space, drivability, energy density and cost. The internal combustion piston engine will for many years continue to be the principal powerplant for these applications.

The four-stroke internal combustion engine currently predominates in the automotive market, with the four cylinder in-line configuration being common. The need for at least four cylinders to achieve a suitable rate of power stroke production dictates the size and shape of this engine, and therefore also greatly limits the designers' options on how the engine is placed within the vehicle. The small cylinders of these engines are typically not optimal for efficient combustion or the reduction of raw emissions. The four cylinder in-line configuration also has drawbacks with respect to passenger comfort, since there are significant unbalanced free-mass forces which result in high noise and vibration levels.

It has long been recognized by engine designers that two-stroke engines have a significant potential advantage over four-stroke engines in that each cylinder produces a power stroke during every crankshaft rotation, which should allow for an engine with half the number of cylinders when compared to a four-stroke engine having the same rate of power stroke production. Fewer cylinders would result in an engine less mechanically complex and less bulky. Two-stroke engines are also inherently less mechanically complex than four-stroke engines, in that the mechanisms for opening and closing intake and exhaust ports can be much simpler.

Two-stroke engines, however, have seen limited use because of several perceived drawbacks. Two-stroke engines have a disadvantage in mean effective pressure (i.e., poorer volumetric efficiency) over four-stroke engines because a significant portion of each stroke must be used for the removal of the combustion products of the preceding power stroke (scavenging) and the replenishment of the combustion air, and is therefore lost from the power stroke. Scavenging is also inherently problematic, particularly when the engine must operate over a wide range of speeds and load conditions. Two-stroke compression-ignition (Diesel) engines are known to have other drawbacks as well, including poor starting characteristics and high particulate emissions.

Modern supercharging and direct fuel injection methods can overcome many of the limitations previously associated with two-stroke engines, making a two cylinder two-stroke engine a viable alternative to a four cylinder four-stroke engine. A two cylinder two-stroke engine has the same ignition frequency as a four cylinder four-stroke engine. If the two-stroke engine provides a mean effective pressure ⅔rds that of the four-stroke, and the effective displacement volume of each cylinder of the two-stroke is increased to ⅔ that of the four-stroke, then the two engines should produce comparable power output. The fewer but larger combustion chambers of the two-stroke would be a better configuration for improvement of combustion efficiency and reduction of raw emissions; the two-stroke could also dispense with the valves of the four-stroke engine, thus permitting greater flexibility in combustion chamber design.

Current production engines are also known to have significant sources of friction loss; increased engine efficiency can be achieved by reducing these friction losses. The largest sources of friction loss in current production automotive engines, accounting for approximately half of all friction losses, are the result of the lateral forces produced by the rotating connecting rods acting on the pistons, pushing them against the cylinder walls. The magnitudes of these losses are a function of the crankshaft throw, r, divided by the connecting rod length, l; the ratio is often designated $\lambda$ (lambda). Decreasing $\lambda$, either by increasing the effective connecting rod length or decreasing the crankshaft throw, potentially yields the greatest overall reduction in friction loss.

The losses due to the contact of the pistons (or more correctly, the piston rings) with the cylinder walls are also a function of the mean velocity of the pistons with respect to the cylinder walls. If the pistons can be slowed down while maintaining the same power output, friction losses will be reduced.

Another significant source of friction loss in current production engines are the large forces acting on the crankshaft main bearings. A typical four cylinder in-line engine has five crankshaft main bearings, which are necessary because there are literally tons of combustion force pushing down on the crankshaft; these forces must be transferred to the supporting structure of the engine. Both the crankshaft and the supporting structure of the engine must be designed with sufficient strength (and the corresponding weight) to accommodate these loads.

SUMMARY OF THE INVENTION

It is the object of the present invention to provide a two cylinder two-stroke internal combustion engine having comparable performance characteristics to current four cylinder four-stroke engines but with improved efficiency, a reduced height profile and lower weight for improved installation suitability, adaptability to advanced supercharging and fuel injection methods, substantially total dynamic balance, and mechanical simplicity for reduced production costs.

Accordingly, an engine mechanism is disclosed that utilizes a single crankshaft and two opposed cylinders having their inner ends adjacent the crankshaft. Each cylinder contains opposed inner and outer pistons reciprocably disposed to form a combustion chamber between them. Pushrods are provided to drivingly couple the inner pistons to the crankshaft, and pullrods drivingly couple the outer pistons to the crankshaft.

Further in accordance with the invention, the crankshaft preferably has at least four separate journals for receiving the driving forces from the respective pullrods and pushrods. Each cylinder has air intake ports and exhaust ports formed near its respective ends, and fuel injection means between the intake and exhaust ports communicating with the combustion chamber.

An important feature of the invention is that the geometrical configurations and masses of the moving parts are selected so as to minimize the dynamic imbalance of the engine during its operation. More specifically, it is preferred to choose the effective mass of each outer piston such that the product of that mass times the throw of the associated crankshaft journal will be essentially equal to the product of the effective mass of each inner piston times the throw of its associated crankshaft journal. This configuration substantially eliminates dynamic imbalance.

According to a further preferred feature of the invention, the pullrod and pushrod journals for each cylinder are arranged asymmetrically so that the exhaust ports of the associated cylinder open before its air intake ports open, and close before its air intake ports close. This asymmetric timing makes it possible to utilize superchargers to enhance engine efficiency.

To provide the asymmetric intake and exhaust port timing of the invention while substantially preserving the dynamic balance, one of the cylinders has the air intake ports on its inner end adjacent the crankshaft, while the other cylinder has its air intake ports on its outer end remote from the crankshaft.

Yet another preferred feature of the invention is that each inner piston on its end remote from the combustion chamber has a smooth end face that is convexly curved in a plane perpendicular to the longitudinal axis of the crankshaft. An associated pushrod assembly then includes a connecting rod coupled to one journal on the crankshaft and has a concavely shaped outer end surface that slidingly engages the curved end face of the inner piston. This pushrod configuration serves to effectively lengthen the pushrods, thereby reducing friction losses and improving dynamic balance.

For receiving the driving force from the outer pistons of the present invention, it is preferred to provide two pullrods for each cylinder. The two pullrod assemblies are on opposite sides of the cylinder, with their inner ends encircling an associated journal of the crankshaft, while their ends remote from the crankshaft are pivotally coupled to the remote end of the respectively associated outer piston.

Maximum power efficiency from an engine according to the present invention is best achieved by applying pressurized air to the intake ports of each cylinder. The presently preferred form of engine with asymmetric timing according to the invention therefore includes two superchargers, each of which is coupled to exhaust ports of an associated cylinder to receive blow-down gasses from that cylinder and to apply pressurized air to the intake ports of that associated cylinder.

BRIEF DESCRIPTION OF THE DRAWINGS

The invention is further described in connection with the accompanying drawings, in which:

FIG. 2(*a*) shows a starting position of the crankshaft, with intake and exhaust ports open in the right-hand piston;

FIG. 2(*b*) shows the relative position of the crankshaft, pistons, and intake and exhaust ports after 45 degrees of rotation;

FIGS. 2(*c*) through 2(*h*) show the relative positions after rotations of 90 degrees, 135 degrees, 180 degrees, 225 degrees, 270 degrees, and 315 degrees, respectively.

FIG. 3(*a*) showing the balance of a single cylinder when its inner and outer pistons are exactly out of phase;

FIG. 3(*b*) shows a basic opposed-piston engine configuration for inner pistons only of the two cylinders;

FIG. 3(*c*) shows a basic opposed-piston engine configuration for outer pistons only of the two cylinders; and FIG. 3(*d*) illustrates the balancing problem when both inner and outer pistons of both cylinders are considered.

FIG. 4(*a*) showing an opposed-piston, opposed-cylinder configuration with symmetric piston timing;

FIG. 4(*b*) shows the same engine configuration with asymmetric exhaust and intake port timing;

FIG. 4(*c*) shows a symmetrically timed engine with the exhaust and intake ports reversed on one cylinder; and FIG. 4(*d*) shows the engine of the preferred embodiment of the present invention.

FIG. 12(*b*) schematically illustrates the supercharging of the preferred embodiment;

DESCRIPTION OF THE INVENTION

1. Overview

Figure 1:
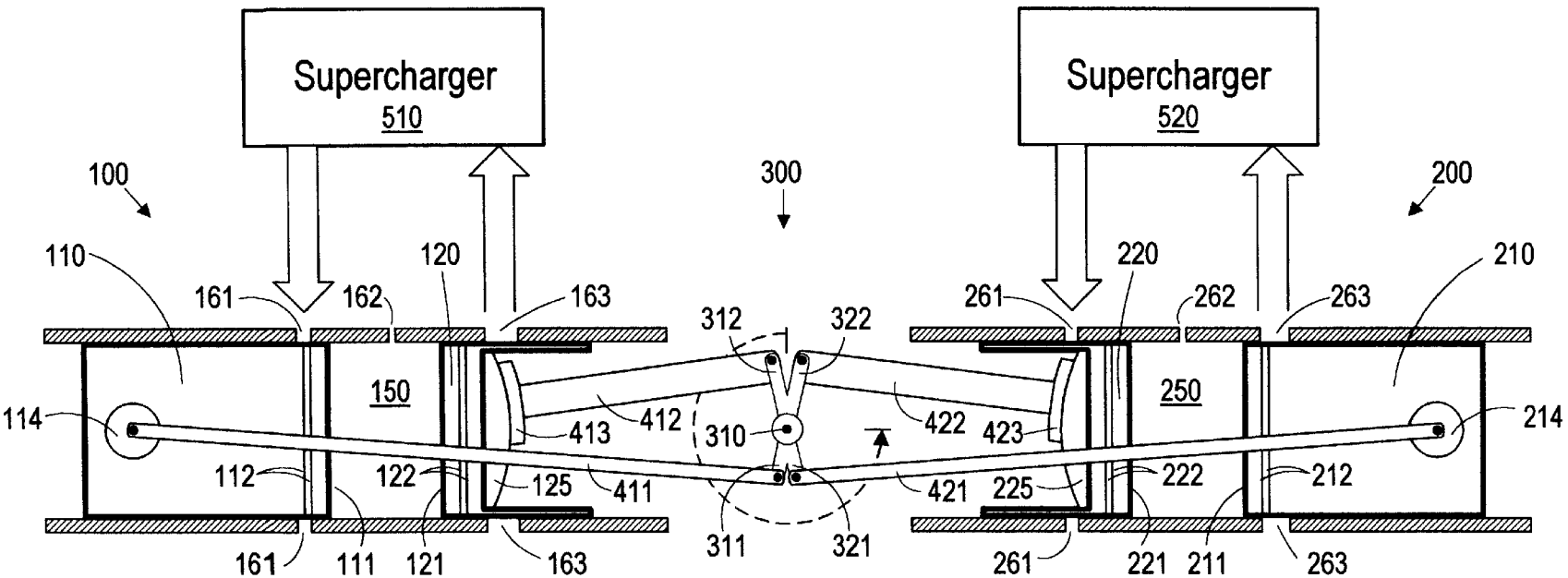
FIG. 1 is a schematic representation of the engine configuration of the present invention.
Figure 2A:
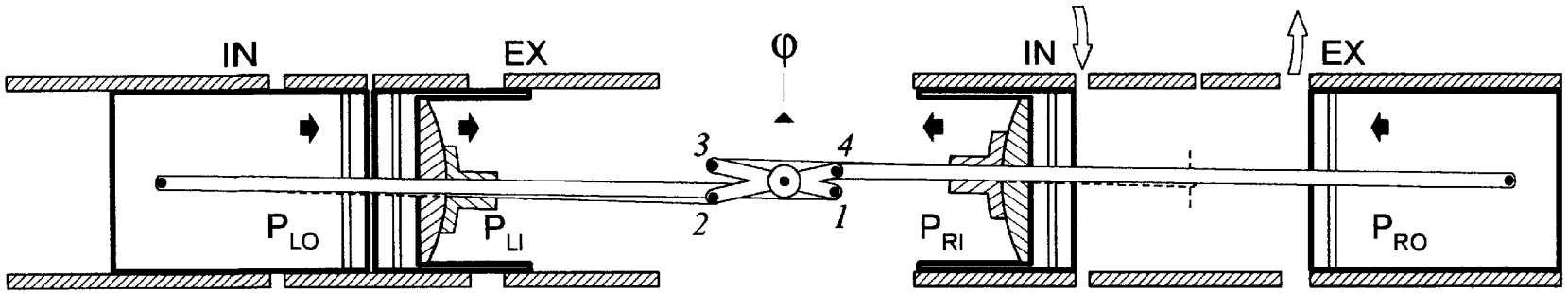
FIG. 2 schematically illustrates the operation of the engine of the present invention over one complete crankshaft rotation, the crankshaft rotation being counterclockwise.
Figure 2B:
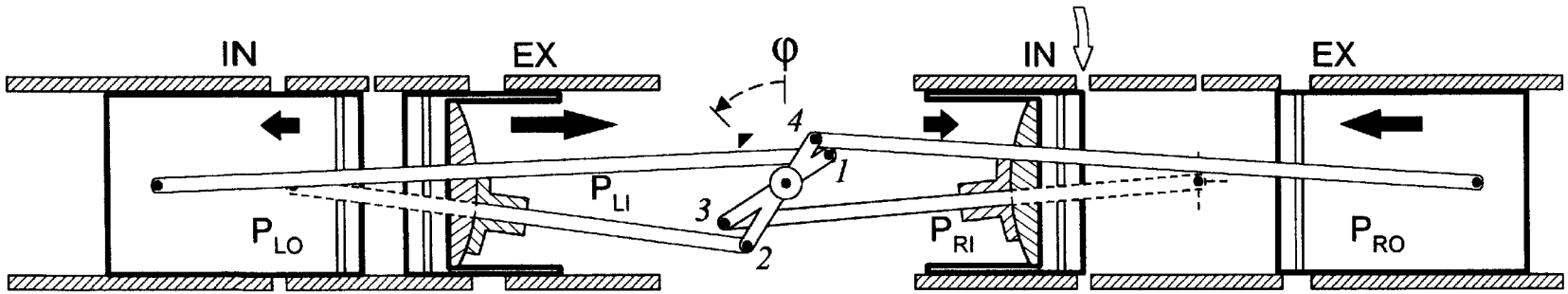
Figure 2C:
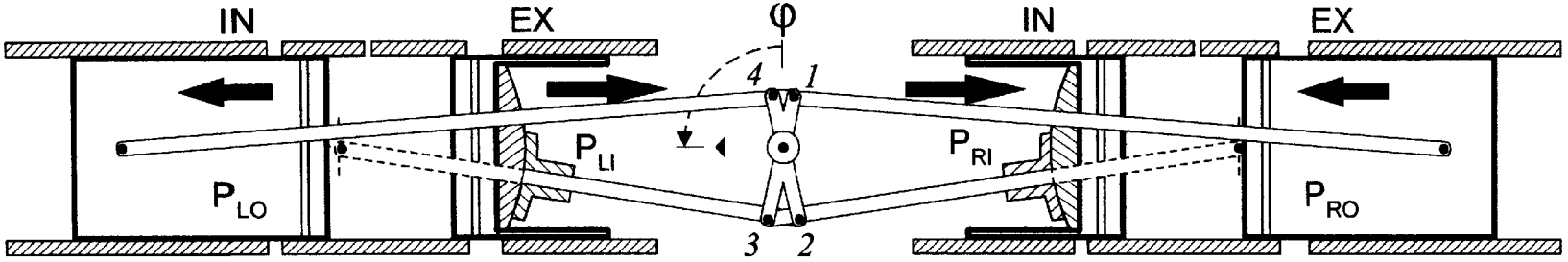
Figure 2D:
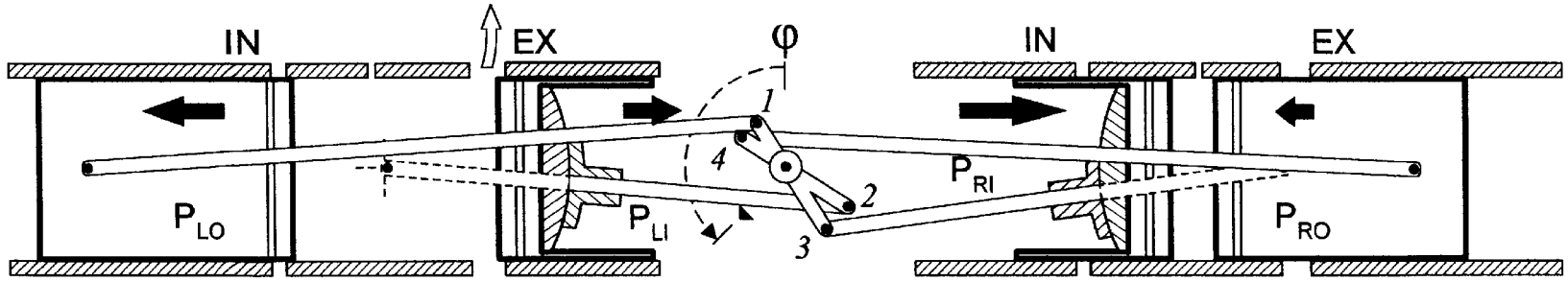
Figure 2E:
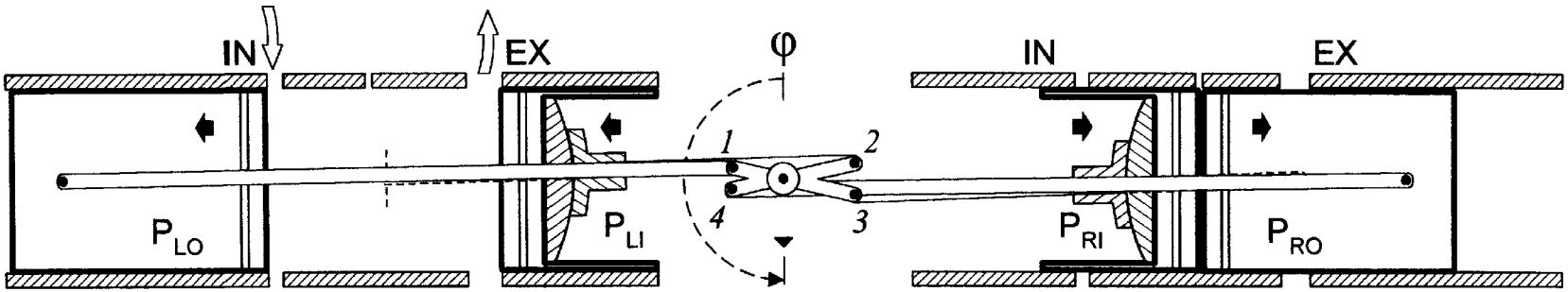
Figure 2F:
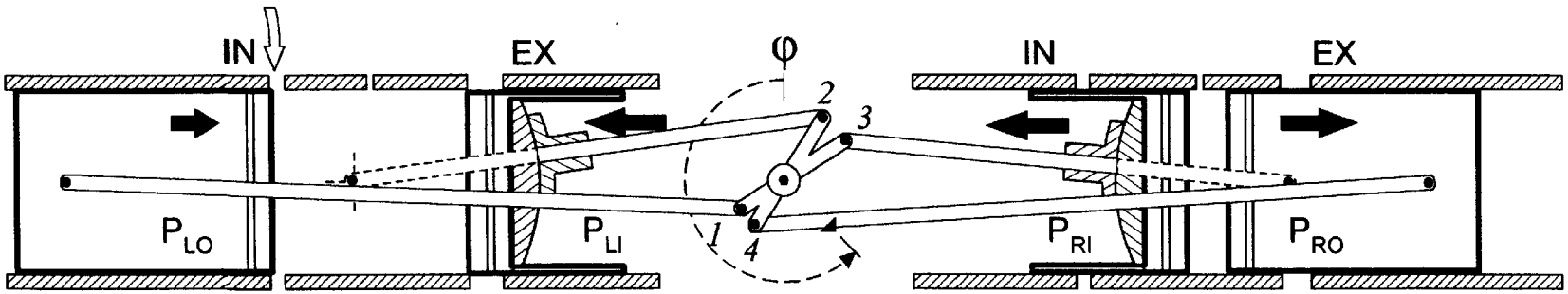
Figure 2G:
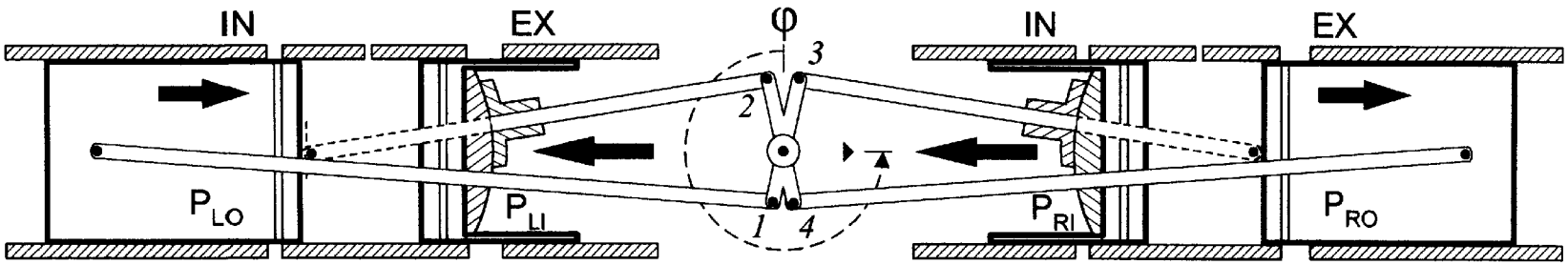
Figure 2H:
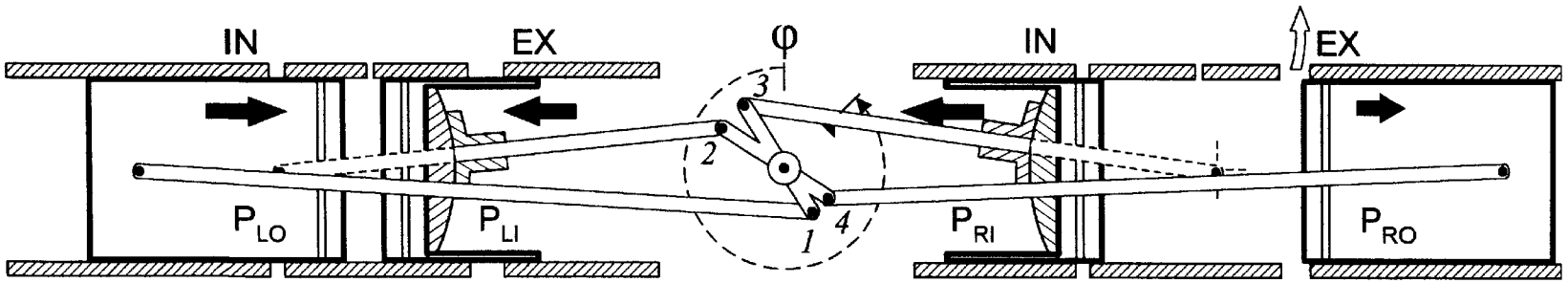
Figure 3A:
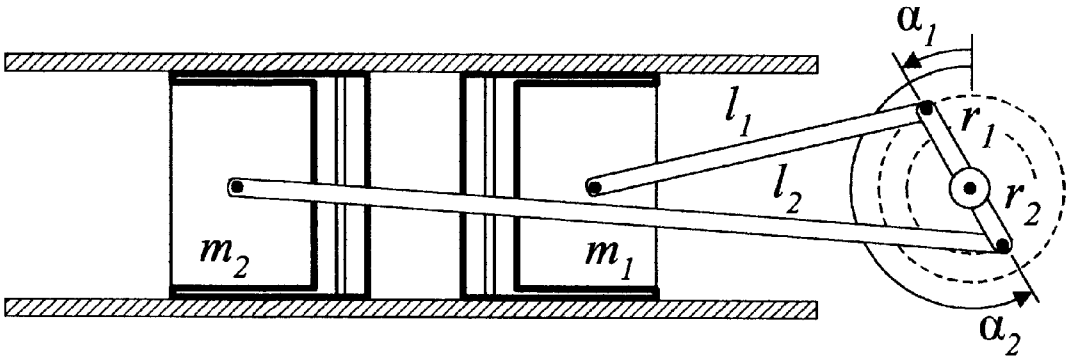
FIG. 3 schematically illustrates the method of balancing the imbalances of the two cylinders.
Figure 3B:
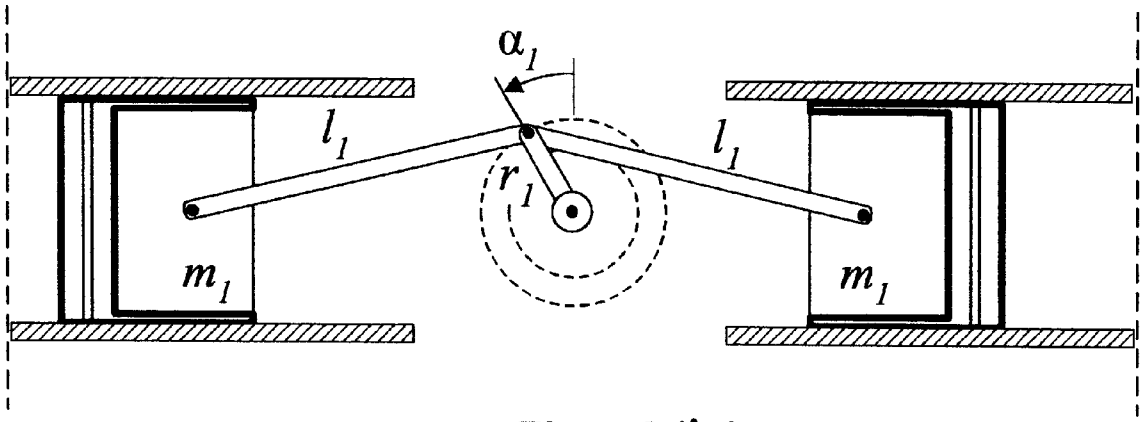
Figure 3C:
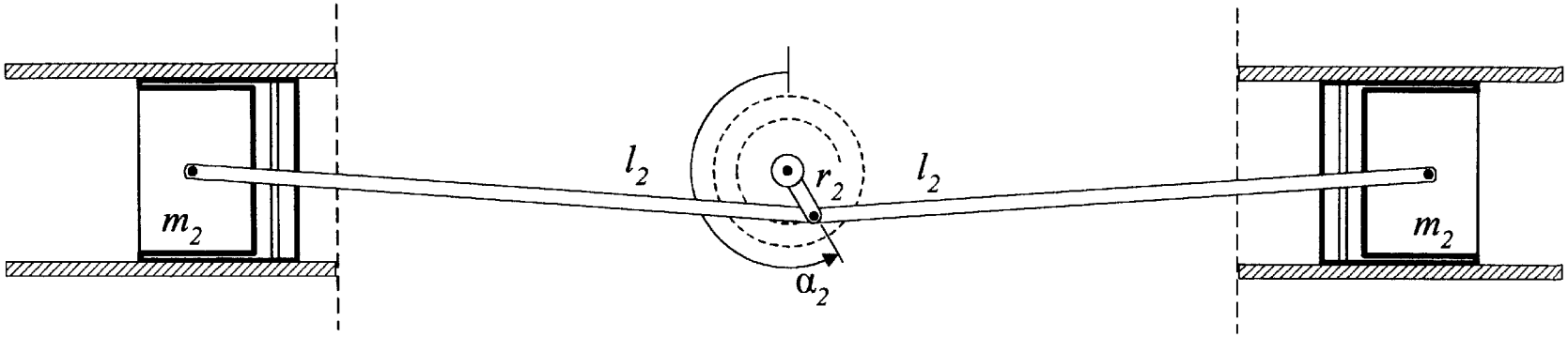
Figure 3D:
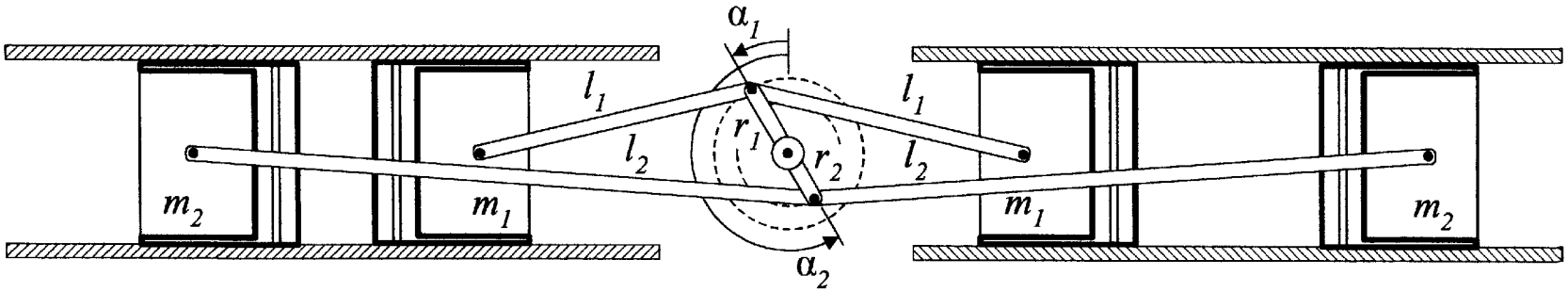
Figure 4A:
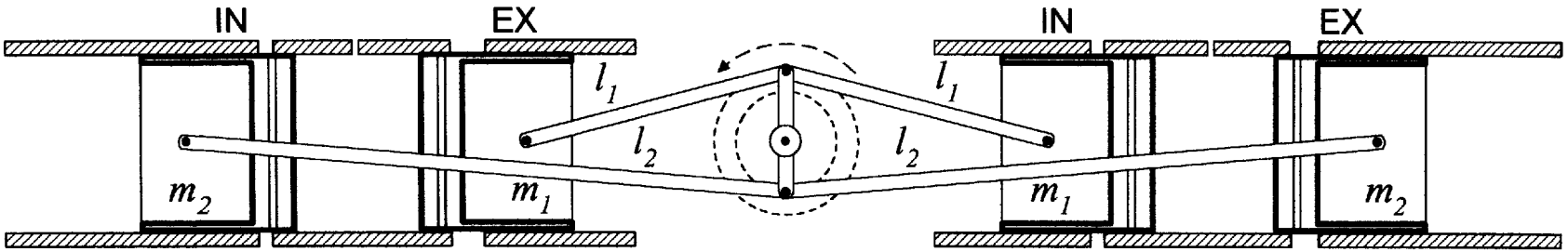
FIG. 4 schematically illustrates the timing operation of the engine of the present invention.
Figure 4B:
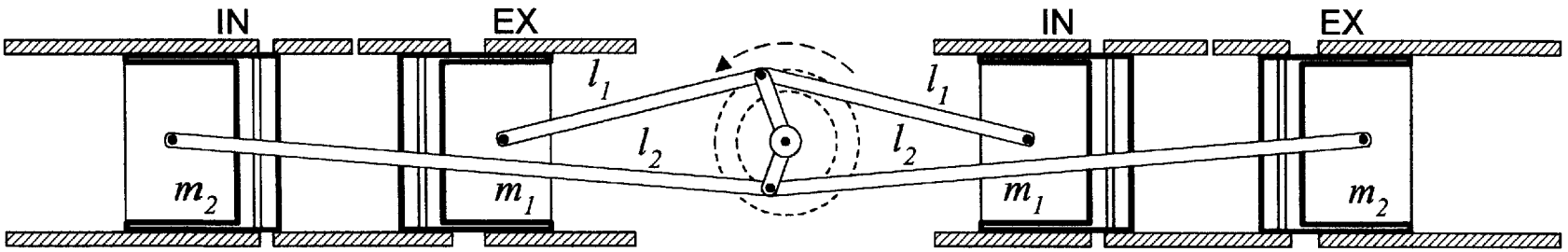
Figure 4C:
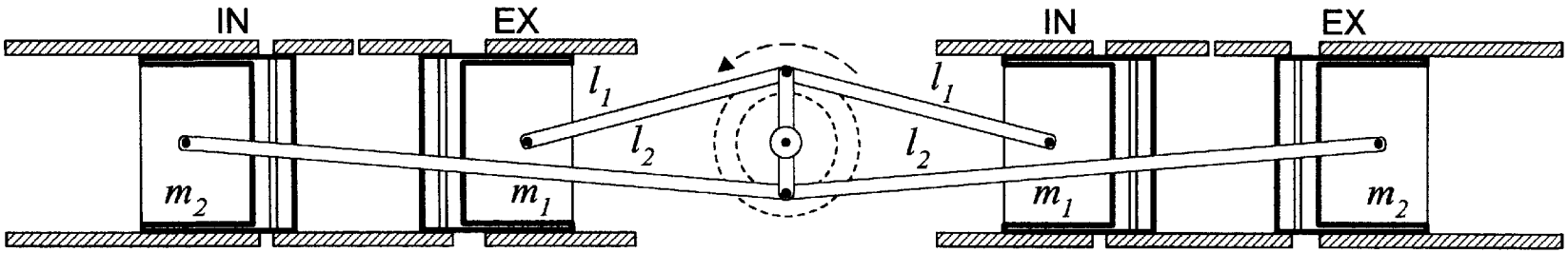
Figure 4D:
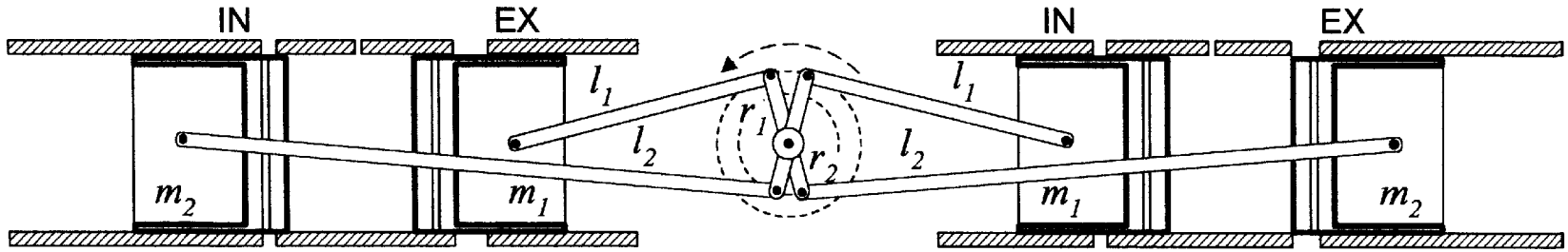

As illustrated in FIG. 1, the engine configuration of the present invention comprises a left cylinder 100, a right cylinder 200, and a single central crankshaft 300 located between the cylinders (for clarity, the supporting structure of the engine is omitted from FIG. 1).

The left cylinder 100 has an outer piston 110 and an inner piston 120, with combustion faces 111 and 121 respectively, the two pistons forming a combustion chamber 150 between them. The right cylinder 200 similarly has an outer piston 210, an inner piston 220, with combustion faces 211 and 221 and combustion chamber 250. Each of the four pistons 110, 120, 210, and 220 are connected to a separate eccentric on the crankshaft 300.

The outer piston 110 of the left cylinder is connected to crankshaft eccentric 311 by means of pullrod 411; the outer piston 210 of the right cylinder is similarly connected to crankshaft eccentric 321 by pullrod 421. While single pullrods are shown in FIG. 1, in the preferred embodiment of the engine pairs of pullrods are used, with one pullrod on the near side of each cylinder and one on the far side, with the near and far side pullrods connected to separate crankshaft journals having the same angular and offset geometries. Since the pullrods 411 and 421 are typically always in tension during normal engine operation and need only support a minor compressive force during engine startup, as will be further explained below, they may be relatively thin and therefore lightweight. The pullrods 411 and 421 communicate with the outer pistons by means of pins 114 and 214 which pass through slots (not shown) in the cylinder walls; outer pistons 110 and 210 are elongated and the pins are located towards the rear of the pistons to prevent gas losses from the cylinders through the slots. The long length of the pullrods relative to the crankshaft throws serves to reduce friction losses in the engine.

The inner piston 120 of the left cylinder is connected to crankshaft eccentric 312 by means of pushrod 412; the inner piston 220 of the right cylinder is similarly connected to crankshaft eccentric 322 by pushrod 422. During normal engine operation, pushrods 412 and 422 are always under compression (as will be discussed below); rather than being connected to the inner pistons by pins, the pushrods have concave ends 413 and 423 which ride on convex cylindrical surfaces 125 and 225 on the rear of the inner pistons. This arrangement serves to effectively lengthen the pushrod length, which reduces friction losses and helps dynamically balance the engine, as discussed below.

The four pistons 110, 120, 210, and 220 are shown with a plurality of piston rings 112, 122, 212, and 222, respectively, located behind the combustion faces. In a practical embodiment of the engine, additional piston rings may be employed further along the piston bodies to prevent the escape of gases from the ports to the crankcase or through the slots (not shown) in the cylinder walls through which the outer pistons communicate with the pullrods.

The cylinders 100 and 200 each have intake, exhaust, and fuel injection ports. On the left cylinder 100, the outer piston 110 opens and closes intake ports 161 and the inner piston 120 opens and closes exhaust ports 163. Fuel injection port 162 is located near the center of the cylinder. On the right cylinder 200, the inner piston 220 opens and closes intake ports 261 and the outer piston opens and closes exhaust ports 263. Again, fuel injection port 262 is located near the center of the cylinder. The asymmetric arrangement of the exhaust and intake ports on the two cylinders serves to help dynamically balance the engine, as described below.

Each of the four crankshaft eccentrics 311, 312, 321, and 322 are uniquely positioned with respect to the crankshaft rotational axis 310. The eccentrics for the inner pistons (312, 322) are further from the crankshaft rotational axis than the eccentrics for the outer pistons (311, 321), resulting in greater travel for the inner pistons than for the outer pistons. The eccentrics for the inner left piston (312) and the outer right piston (321), the pistons which open and close the exhaust ports in the two cylinders, are angularly advanced, while the eccentrics for the outer left piston (311) and inner right piston (322) are angularly retarded (note that the direction of crankshaft rotation is counterclockwise, as indicated by the arrow).

The unique positions of the eccentrics contribute both to engine balance and to engine operation with respect to supercharging and recovering energy from the exhaust blowdown, as discussed below. The engine balance results in most non-rotational forces on the crankshaft canceling, thus permitting a simplified crankshaft design, as also discussed below. The use of opposed pistons achieves a larger combustion volume per cylinder while at the same time reducing the crankshaft throws, thereby reducing the engine height; the pushrod configuration allows for a short, compact engine, while reducing friction losses due to lateral forces on the pistons.

Compared to a current state-of-the-art production four cylinder in-line engine having comparable performance, the engine of the present invention provides substantial improvements in installation suitability, the reduction of friction losses, and the elimination of vibration. The height of the opposed-piston opposed-cylinder engine is determined primarily by the maximum sweep of the crankshaft. With the opposed piston design, the crankshaft throws may be cut roughly in half for the same cylinder displacement. A reduced height of approximately 200 mm is therefore possible, compared to a 450 mm height for a four cylinder in-line engine. The single central crankshaft and pushrod configuration permit a relatively compact engine with a width of approximately 790 mm, which is within the available installation width for automobiles. The overall volume of the engine of the present invention represents an approximately 40% reduction over a four cylinder in-line engine, with a corresponding 30% reduction in weight.

Friction due to lateral forces on the pistons is greatly reduced by this design. A state-of-the-art four cylinder in-line engine has a crankshaft throw to connecting rod ratio ($\lambda$) of approximately ⅓. Because of the long pullrods and short crankshaft throws, the outer pistons of the present invention achieve a $\lambda$ of approximately 1/12. The inner pistons, with the pushrods sliding on the convex surface on the rear of the pistons and thereby effectively lengthening the connecting rods, achieve a $\lambda$ of approximately 1/7.

Although the two cylinder engine of the present invention has the same total number of pistons as a conventional four cylinder in-line engine, for a comparable power output the mean piston velocity is substantially reduced since each piston travels a shorter distance. For the inner pistons, the mean piston velocity is reduced approximately 18% compared to a typical four cylinder engine; for the outer pistons, the mean piston velocity is reduced approximately 39% (the asymmetry in the length of the throws is discussed below).

The opposed-piston configuration substantially eliminates the non-rotational combustion forces on the main bearings, since the pull from the outer piston counteracts the push from the inner piston, resulting in primarily rotational forces on the crankshaft. The number of main bearings can therefore be reduced to as few as two, and the crankshaft and supporting engine structure may be made lighter.

The engine of the present invention may be essentially totally dynamically balanced as discussed below, although a slight residual dynamic imbalance is accepted in exchange for asymmetric timing of the intake and exhaust ports. With this residual imbalance, the calculated maximum free-mass forces for the engine are approximately 700 N at 4500 rpm, as compared to approximately 10,000 N for a four cylinder in-line engine; a reduction of 93%.

The engine configuration of the present invention is well-suited to supercharging. As shown in FIG. 1, in the preferred embodiment each cylinder of the engine has a separate supercharger (510, 520). With only two cylinders, a supercharger may economically be dedicated to each cylinder, making more practical such techniques as pulse turbocharging. The superchargers preferably are electric-motor assisted turbochargers, which serve to improve scavenging, improve engine performance at low rpms while avoiding turbo lag, and recover energy from the engine exhaust, as described below.

2. Operation of the Engine

FIG. 2 schematically illustrates the operation of the engine of the present invention over one complete crankshaft rotation. FIGS. 2(*a*) through 2(*h*) illustrate the piston positions, intake and exhaust ports, and relative piston velocities at approximately 45° increments; note that crankshaft rotation in FIG. 2 is counterclockwise. Crankshaft angle $\phi$ is indicated by the small triangle and dashed arrowed arc. Since the connecting rods (pushrods and pullrods) cross at various crankshaft positions, the four crankshaft journals are numbered for clarity, with journals 1, 2, 3, 4 connecting to the left outer, left inner, right inner, and right outer pistons, respectively. For illustrative purposes, the end portions of the sliders of the inner pushrods and the convex surfaces at the rear of the inner pistons are shown, and the "effective" lengths of the inner pushrods are shown in dashed lines.

FIG. 2(*a*) shows the engine at a crankshaft position of 0° (arbitrarily defined as "Top Dead Center," or TDC, of the left cylinder). At this position, the left outer piston ($P_{LO}$) and left inner piston ($P_{LI}$) are very near their point of closest approach. At approximately this angle of crankshaft rotation, in a direct injection version of the engine, a fuel charge would be injected into the left cylinder and combustion would begin (an actual engine would have more complex piston faces, forming a combustion chamber between them; the flat piston faces of FIG. 2 are intended only to illustrate the relative piston locations). At this point the intake and exhaust ports (IN and EX) of the left cylinder are completely closed by $P_{LO}$ and $P_{LI}$, respectively. Since the timing of the pistons actuating the exhaust ports are advanced by approximately 12.5° and the timing of the pistons actuating the intake ports are retarded by approximately the same amount, both pistons $P_{LO}$ and $P_{LI}$ have a slight motion to the right, as indicated by the arrows (the inner left piston, $P_{LI}$, having just reversed direction). Since the crankshaft throws of the two pistons are different, the piston velocities will also be slightly different.

In the right cylinder in FIG. 2(*a*), the right inner piston ($P_{RI}$) and right outer piston ($P_{RO}$) are near their maximum separation. Both the intake and exhaust ports (IN and EX) of the right cylinder are open, and the exhaust gases from the previous combustion cycle are being scavenged ("uniflow" scavenging). Like the pistons in the left cylinder, both $P_{RI}$ and $P_{RO}$ have a slight velocity, in this case towards the left, with the outer piston $P_{RO}$ having just changed direction.

In FIG. 2(*b*), pistons $P_{LO}$ and $P_{LI}$ of the left cylinder are moving apart in a power stroke, the outer piston having changed its direction of travel; the inner piston is moving at a significantly higher velocity than the outer piston, as indicated by the magnitude of the arrows. In the right cylinder, outer piston $P_{RO}$ has closed the exhaust ports EX, while intake ports IN remain partially open for supercharging.

In FIG. 2(*c*), the left cylinder continues its power stroke, with the two pistons $P_{LO}$ and $P_{LI}$ having more nearly equal but opposite velocities; in the right cylinder, piston $P_{RI}$ has closed the intake ports IN, and the two pistons are moving towards one another, compressing the air between them.

In FIG. 2(*d*), left inner piston $P_{LI}$ has opened the exhaust ports EX of the left cylinder, while the intake ports remain closed. In this "blowdown" condition, some of the kinetic energy of the expanding gases in the combustion chamber can be recovered externally for turbocharging ("pulse" turbocharging) or for generating electrical energy. In the right cylinder, the two cylinders continue the compression stroke.

In FIG. 2(*e*), left outer piston $P_{LO}$ has opened the intake ports IN, and the cylinder is being scavenged. The inner piston, $P_{LI}$ has changed its direction of travel. The right cylinder has reached the position analogous to TDC, with the two pistons $P_{RI}$ and $P_{RO}$ having a slight velocity to the right, the outer piston having changed its direction of travel.

In FIG. 2(*f*), left inner piston $P_{LI}$ has closed the exhaust ports EX, while the intake ports IN remain open for supercharging the cylinder. The outer piston $P_{LO}$ has passed its point of maximum travel and reversed direction. The right cylinder is on its power stroke, with the two pistons traveling apart.

In FIG. 2(*g*), left outer piston $P_{LO}$ has closed the intake ports IN, and the two pistons $P_{LO}$ and $P_{LI}$ are moving towards one another, compressing the air between them. The right cylinder continues its power stroke.

In FIG. 2(*h*), the left cylinder continues its compression stroke, nearing the "TDC" position of FIG. 2(*a*). In the right cylinder, outer piston $P_{RO}$ has opened exhaust ports EX, while the intake ports remain closed ("blowdown").

The specific angles and timing depend on the crankshaft geometries and port sizes and locations; the above description is intended solely to illustrate the concepts of the invention.

3. Balancing of Free Mass Forces

One important goal in engine design is the balancing of free-mass forces to eliminate vibration and to reduce the periodically variable loads within the crankshaft, block, and other structures. A single piston connected to a crankshaft journal through a connecting rod will generate free-mass forces of the first-order (having the same frequency as the crankshaft rotation) and of higher orders (at frequencies that are multiples of the crankshaft rotation frequency). The opposed-piston opposed-cylinder single central crankshaft configuration of the present invention allows for essentially total balancing of the free-mass forces, both of first-order and of higher order. Although in theory it would be possible to independently balance each cylinder of the engine, the present invention utilizes a different approach, allowing some imbalance in each cylinder, which is offset by a corresponding imbalance in the opposite cylinder. This approach avoids some serious design constraints that would otherwise impact engine design.

The approach to achieving dynamic balance in the present invention can be understood best by first examining the problems inherent in balancing one cylinder alone. Referring to FIG. 3, a single cylinder of the engine is depicted in FIG. 3(*a*), and the method used to balance the engine of the present invention is illustrated in FIGS. 3(*b*), 3(*c*), and 3(*d*).

Assuming the two pistons are 180° out of phase (i.e., $\alpha_1$ and $\alpha_2$ are exactly out of phase, as depicted in FIG. (3*a*)), it can be shown that the free-mass forces of the single-cylinder configuration depicted in FIG. 3(*a*) will be balanced for first- and second-order forces if the following two conditions are met:

$$\frac{r_1}{l_1} = \frac{r_2}{l_2} \quad [1]$$

and $$r_1 \cdot m_1 = r_2 \cdot m_2 \quad [2]$$

where $r_1$ is the throw length of the inner piston $r_2$ is the throw length of the outer piston $l_1$ is the connecting rod length of the inner piston $l_2$ is the connecting rod length of the outer piston $m_1$ is the effective mass of the inner piston $m_2$ is the effective mass of the outer piston.

However, meeting both condition (1) and condition (2) is difficult, since, in any practical design, $l_2$ (the connecting rod length of the outer piston) will be significantly greater than $l_1$ (the connecting rod length of the inner piston). The more compact the engine, the greater this difference will be. This will be the case even with the slider pushrod of the preferred embodiment of the present invention, which effectively lengthens $l_1$ somewhat.

The differing lengths of the two connecting rods imposes design constraints on the relative throws of the two pistons and on the relative effective masses of the pistons (if the dynamic forces within the cylinder are to be balanced). To meet condition (1), the throw of the outer piston, $r_2$, must be made greater than the throw of the inner piston, $r_1$, in the same proportion as the connecting rod lengths. To meet condition (2), the effective mass of the inner piston, $m_1$, must be made greater than the effective mass of the outer piston, $m_2$, again by the same proportion. Both of these requirements unduly constrain engine design. It may desirable, for example, to increase the length of the outer piston, and hence also increase its mass, to accommodate a second set of piston rings as discussed below. It should also be noted that the effective mass of the outer piston includes a contribution from the pullrod which in a practical design will be greater than that of the pushrod's contribution to the inner piston's effective mass, thus tending to unbalance the cylinder further.

To avoid the limitations imposed by conditions (1) and (2) above, the present invention does not seek to completely balance each cylinder, but instead utilizes the approach illustrated in FIGS. 3(*b*), 3(*c*), and 3(*d*).

It is well understood that the basic opposed-piston engine configuration (or "V-180°") of FIG. 3(*b*) has balanced free-mass forces except for first-order forces (the higher-order free mass forces contributed by each of the two pistons exactly cancel, leaving only first-order free mass forces for the total engine). It is further understood that the first-order free-mass forces of this engine configuration are proportional to the effective piston mass times the throw, or:

$$F_1 = 2 \cdot m_1 \cdot r_1 \cdot \omega^2 \cdot \sin(\alpha_1 + \omega t) \quad [3]$$

By analogy to the engine configuration of FIG. 3(*b*), the engine configuration of FIG. 3(*c*) can also be shown to have balanced free-mass forces except for first order forces, or:

$$F_2 = 2 \cdot m_2 \cdot r_2 \cdot \omega^2 \cdot \sin(\alpha_2 + \omega t) \quad [4]$$

For the purpose of understanding how dynamic balance is achieved, the engine configuration of the present invention, as illustrated in FIG. 3 (*d*) may be viewed as comprising the engines of FIGS. 3(*b*) and 3(*c*) superimposed, with the total free-mass forces equal to:

$$F_T = F_1 + F_2 = 2 \cdot \omega^2 \cdot [m_1 \cdot r_1 \cdot \sin(\alpha_1 + \omega t) + m_2 \cdot r_2 \cdot \sin(\alpha_2 + \omega t)] \quad [5]$$

If $\alpha_1$ and $\alpha_2$ are selected such that the "engine" of FIG. 3 (*b*) is 180° out of phase with the "engine" of FIG. 3(*c*), then $\sin(\alpha_1+\omega t) = -\sin(\alpha_2+\omega t)$, and the total first-order free-mass forces for the "combined" engine will be proportional to $m_1 \cdot r_1 - m_2 \cdot r_2$, and, if $$m_1 \cdot r_1 - m_2 \cdot r_2 = 0 \quad [6]$$

then the total first-order free-mass forces of the combined engine will be zero.

Thus, the engine configuration of FIG. 3(*d*) is totally balanced because the component "engines" shown in FIGS. 3(*b*) and 3(*c*) are each balanced except for first-order free-mass forces, and the first-order free-mass forces of the two component "engines" are made to cancel by setting $$m_1 \cdot r_1 = m_2 \cdot r_2 \quad [7]$$

Note that although in each component "engine" one piston opens and closes exhaust ports and the other opens and closes intake ports, and may therefore preferably have different combustion face designs and different cross sections, the masses of the two pistons in each engine are matched.

Balancing the engine in this manner has the significant advantage that the lengths of the connecting rods are not determinant factors in achieving dynamic balance. In practice, it is relatively straight-forward to determine by analysis the effective masses of the inner and outer pistons (including the contributions of the pullrods and pushrods), and then calculate the crankshaft throws, $r_1$ and $r_2$, required to achieve balance. Note that in the preferred embodiment, the greater effective masses of the outer pistons requires that the stroke of the outer pistons be significantly shorter than the throws of the inner pistons, which is the opposite of what would be required for balancing each cylinder independently.

The above discussion assumes an engine having symmetrically timed intake and exhaust ports and vertical alignment of the two cylinders and the crankshaft. While the basic opposed-piston opposed-cylinder configuration of the present invention can be essentially totally balanced as described, the preferred embodiment accepts a slight residual imbalance to allow for asymmetric timing of the intake and exhaust ports, as discussed below. Even with this residual imbalance, computer analysis indicates that the free-mass forces of the preferred embodiment will be an order of magnitude less than the free-mass forces of a standard 4-cylinder inline 4-stroke engine of comparable performance.

4. Asymmetric Timing of Intake and Exhaust Ports

Asymmetric timing of the intake and exhaust ports in a two-cycle engine yields a number of important advantages. If the exhaust ports open before the intake ports, energy in the exhaust gases can be more effectively recovered by a turbocharger; if the exhaust ports close before the intake ports, the cylinder can be more effectively supercharged.

In the engine configuration of the present invention, the intake ports are controlled by one piston in each cylinder and the exhaust ports are controlled by the other piston, as described above. This configuration not only allows for effective scavenging ("uniflow" scavenging), but permits independent, asymmetric timing of the intake and exhaust ports.

Asymmetric timing of the two pistons in each cylinder is achieved by changing the relative angular positions of the corresponding crankshaft journals (ref FIG. 1). Positioning the journals for the two pistons 180° apart would result in the two pistons both reaching their minimum and maximum excursions at the same time (symmetric timing); in the preferred embodiment of the present invention, the journals for the exhaust ports are angularly advanced by approximately 12.5°, and journals for the intake pistons are angularly retarded by approximately 12.5° ("Top Dead Center" thus still occurs at the same crankshaft angle as in the symmetrically timed engine, but the two pistons have a slight common motion with respect to the cylinder). As a result, the exhaust ports open before the intake ports for "blowdown" and close before the intake ports for supercharging.

The engine configuration of the present invention thus incurs some imbalance of the free-mass forces (as discussed above) in exchange for asymmetric intake and exhaust port timing (a slight vertical offset of the two cylinders also contributes to this imbalance, as descussed below). In the preferred embodiment, this imbalance is kept to a minimum by reversing the relative positions of the intake and exhaust ports on one cylinder, as illustrated in FIG. 4.

FIG. 4(*a*) shows an opposed-piston, opposed-cylinder configuration with symmetric piston timing. The exhaust ports of both cylinders are inboard (i.e., nearest the crankshaft) and the intake ports are outboard. The free-mass forces in this engine may be essentially totally balanced, as described above.

FIG. 4(*b*) shows the same engine configuration with asymmetric exhaust and intake port timing. The two "engines" described in reference to FIGS. 3(*b*) and 3(*c*) are no longer out of phase, and thus this engine will have some residual, uncancelled first-order free-mass forces. This would be a viable engine configuration, though, as the uncancelled free-mass forces would be much less than those in a conventional in-line four-cylinder engine.

The preferred embodiment achieves a more optimal balance than that shown in FIG. 4(*b*) by reversing the intake and exhaust ports on one of the two cylinders, as illustrated in FIGS. 4(*c*) and 4(*d*). FIG. 4(*c*) shows a symmetrically timed engine with the exhaust and intake ports reversed on one cylinder; assuming the piston masses are the same, this engine has the same free-mass balance as the engine of 4(*a*) FIG. 4(*d*) shows the engine of the preferred embodiment. Reversing the positions of the exhaust and intake ports on one cylinder requires "splitting" the throws of the crankshaft to preserve correct port timing. This engine has unbalanced free mass forces, but these forces are negligible as they are less than 1/10 the free mass forces of second order seen in a 4-cylinder in-line engine. Improved balance results from each inner piston being substantially 180° out of phase with the outer piston in the opposite cylinder. If lambda (the crankshaft throw divided by the connecting rod length) of the inner pistons equals lambda of the outer piston, then again, this asymmetric configuration will be perfectly balanced (neglecting a minor additional imbalance introduced to further reduce friction losses, as discussed below). In the configuration of the preferred embodiment, therefore, the increased effective length of the inner piston pushrods contributes to the dynamic balance.

While for the purpose of dynamic balance it is desirable to make the effective lengths of the inner pushrods longer (by increasing the radius of curvature of the cylindrical convex surface on the rear of the inner pistons) two factors limit the extent to which this is practical. First, if the radius is too large, the lateral forces on the slider will be insufficient to cause it to track correctly on the surface. Second, there can be mechanical interference between the pushrods and the cylinder walls if the pushrods are made too long. Since it is also desirable to make the engine as compact as practical, this second factor becomes the limiting factor in the preferred embodiment.

5. Further Illustration of Asymmetric Timing in the Preferred Embodiment

Figure 5:
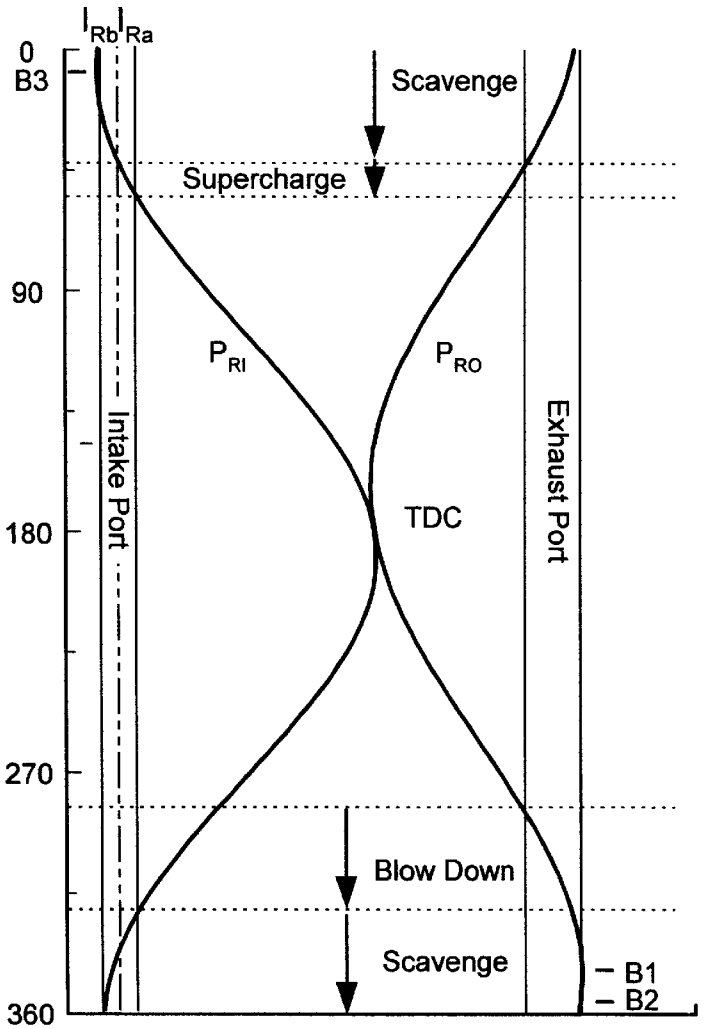
FIG. 5 is a further illustration of the asymmetric timing of the preferred embodiment, with piston location linearly plotted for one complete crankshaft rotation.
Figure 5:
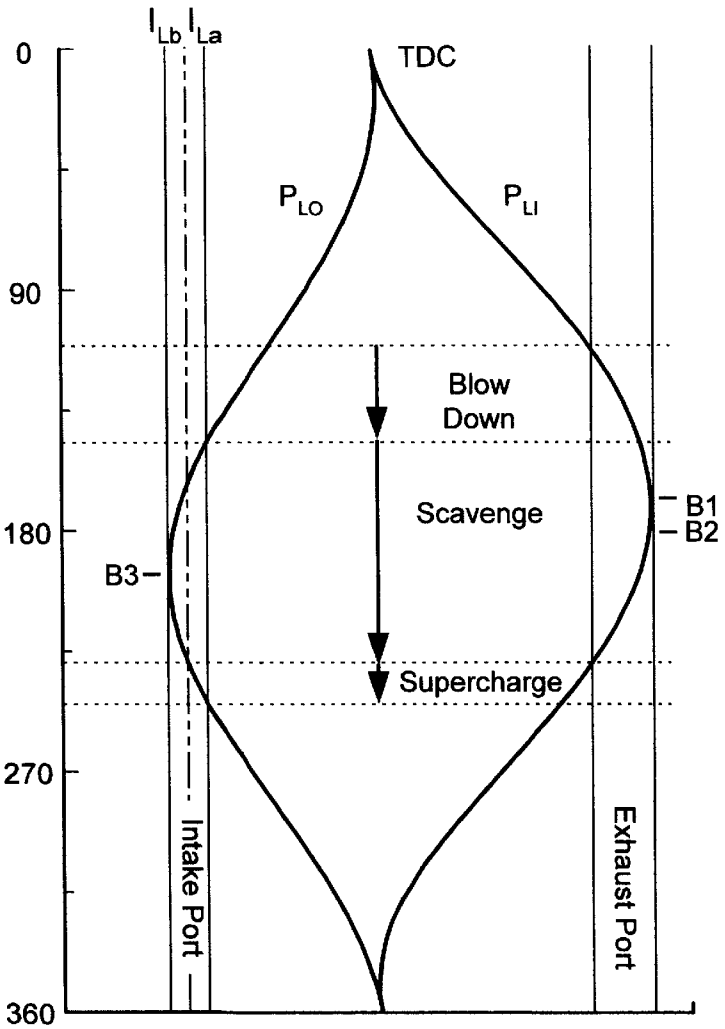

The operation of the preferred embodiment is still further illustrated in FIG. 5, which shows the positions of the piston faces within the cylinders as a function of crankshaft angle for one complete crankshaft rotation. The positions of the intake and exhaust ports in the cylinder walls are also shown. In FIG. 5 the asymmetric timing of the two pistons within each cylinder can clearly be observed, with the two pistons reaching their maximum excursions at different crankshaft angles, and moving together with respect to the cylinder at "TDC". It may also be observed that the inner pistons have a greater travel than the outer pistons, due to the different crankshaft throws. Since the intake ports are operated by the outer left and inner right pistons, and the exhaust ports are operated by the inner left and outer right pistons, the intake and exhaust port dimensions for the two cylinders will be somewhat different.

6. Adaptability of the Opposed-Piston Opposed-Cylinder Configuration to Larger Engines In many engine configurations balance depends on having four, six, eight, or more cylinders arranged such that the free mass forces contributed by the individual pistons cancel.

Counter-rotating weights are also often employed, adding complexity to the engines. An advantage of the present invention is that substantially total balance may be achieved in a compact engine with only two cylinders. Larger engines may then be made by placing multiple small engines side-by-side, and coupling their crankshafts together. The coupling may be by such means as an electric clutch, allowing pairs of cylinders to be uncoupled when not needed at low loads. Engines currently exist which use less than all of their cylinders when run at partial load, but the cylinders remain connected to the crankshaft and the pistons continue to move within the cylinders, and therefore continue to be a friction load on the engine.

DETAILED DESCRIPTION OF THE PREFERRED EMBODIMENT

1. Physical Description

Figure 6:
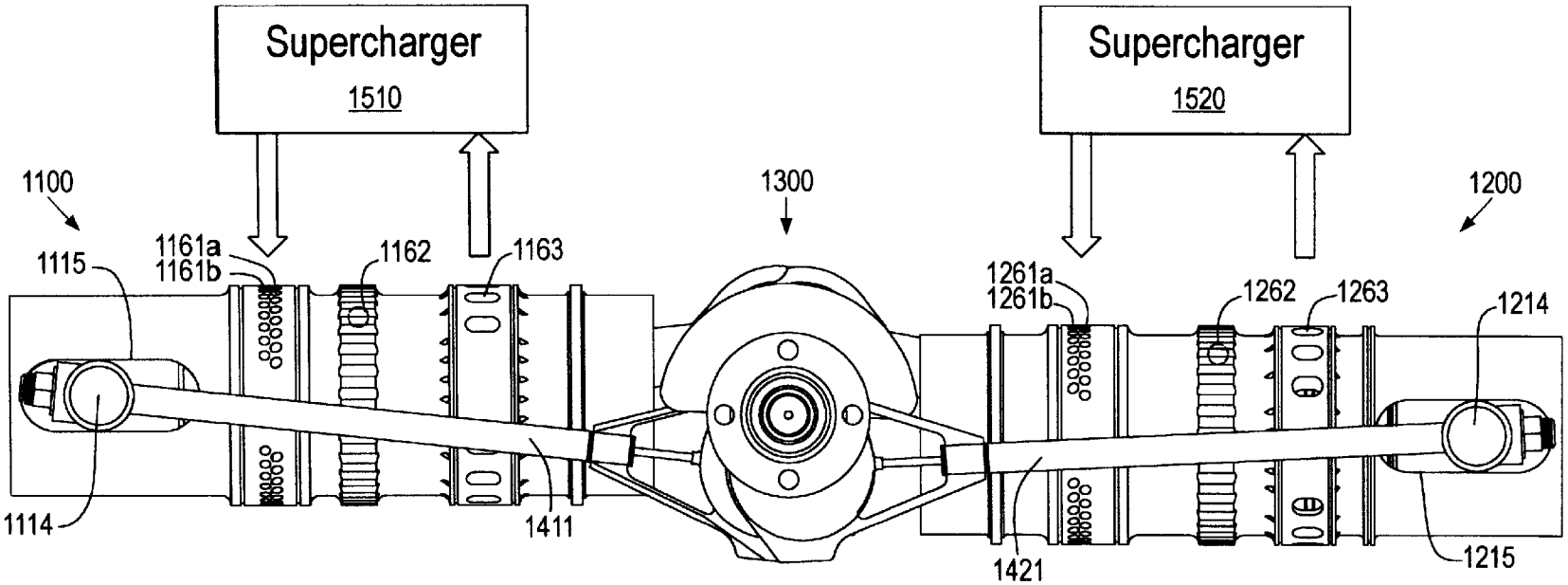
FIG. 6 is a front plan view of the preferred embodiment of the present invention.
Figure 7:
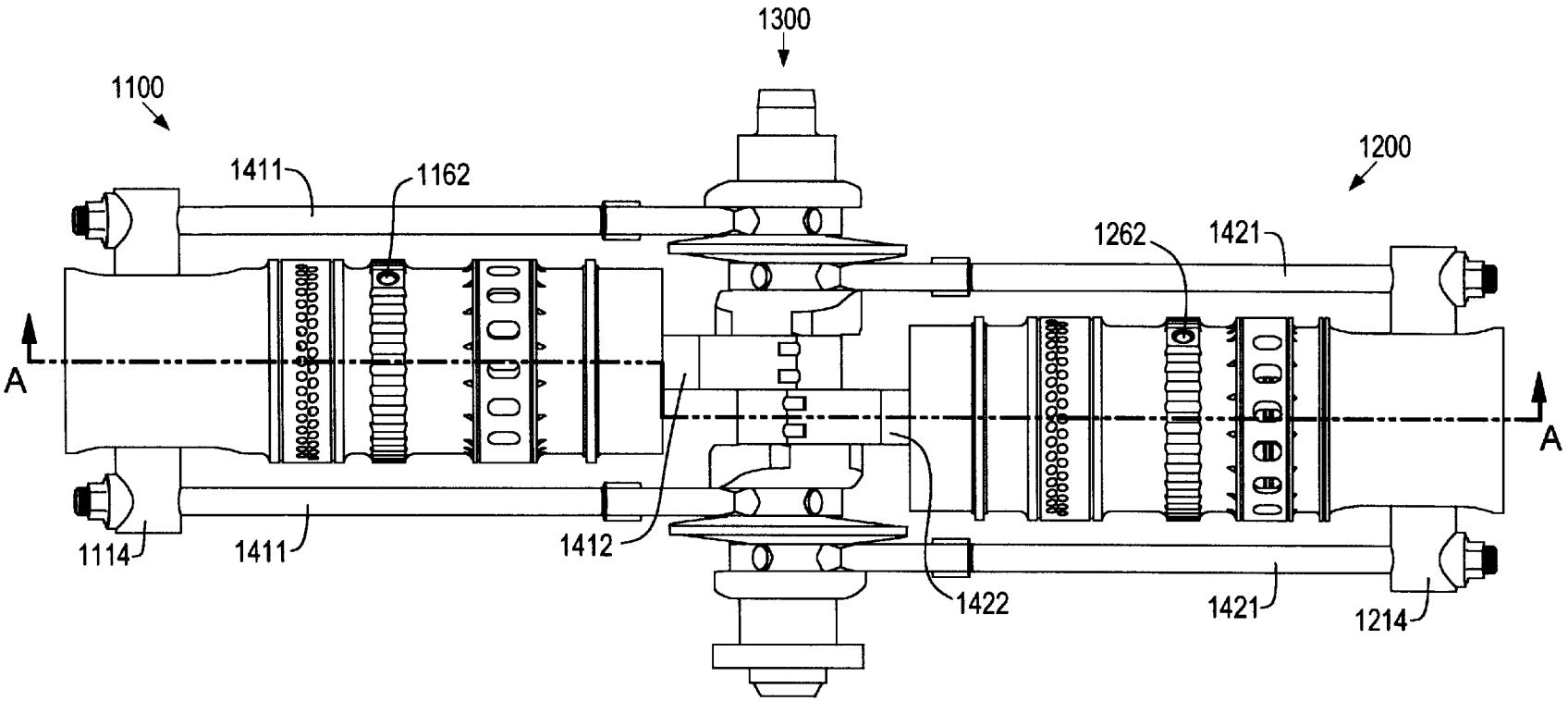
FIG. 7 is a top plan view of the preferred embodiment of the present invention.
Figure 8:
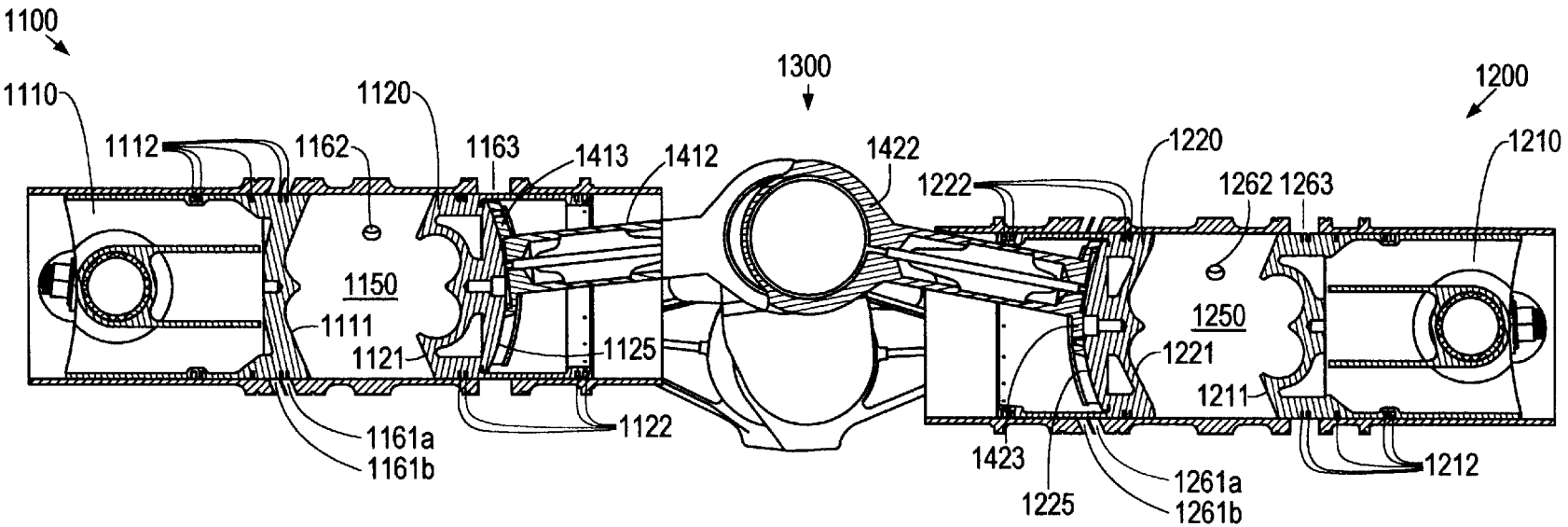
FIG. 8 is a front sectional view of the preferred embodiment of the present invention, through section A—A of FIG. 7.

The presently preferred implementation of the invention is further illustrated in FIGS. 6, 7, and 8, which are front plan view, top plan view, and front sectional views, respectively. The figures depict the engine at a crankshaft angle of 270° after TDC of the left cylinder. The engine comprises a left cylinder 1100, a right cylinder 1200, and a single central crankshaft 1300 located between the cylinders (the supporting structure of the engine is not shown).

As shown in FIG. 8, the left cylinder 1100 has an outer piston 1110 and an inner piston 1120, with combustion faces 1111 and 1121 respectively, the two pistons forming a combustion chamber 1150 between them. The right cylinder 1200 similarly has an outer piston 1210, an inner piston 1220, with combustion faces 1211 and 1221 and combustion chamber 1250. Each of the four pistons 1110, 1120, 1210, and 1220 are connected to a separate eccentric on the crankshaft 1300.

As best seen in FIG. 7, The outer piston 1110 of the left cylinder is connected to the crankshaft by means of two pullrods 1411, one on either side of the cylinder; the outer piston 1210 of the right cylinder is similarly connected to the crankshaft by two pullrods 1421. The pullrods 1411 and 1421 communicate with the outer pistons by means of pins 1114 and 1214 that pass through slots 1115 and 1215 in the cylinder walls (see FIG. 6).

The inner piston 1120 of the left cylinder is connected to the crankshaft by means of pushrod 1412; the inner piston 1220 of the right cylinder is similarly connected to the crankshaft by pushrod 1422. The pushrods have concave ends 1413 and 1423 that ride on convex cylindrical surfaces 1125 and 1225 on the rear of the inner pistons.

The four pistons 1110, 1120, 1210, and 1220 have a plurality of piston rings 1112, 1122, 1212, and 1222, respectively, located both behind the combustion faces and further along the piston bodies to prevent the escape of gases from the ports to the crankcase or through the slots in the cylinder walls through which the outer pistons communicate with the pullrods.

The cylinders 1100 and 1200 each have intake, exhaust, and fuel injection ports. The intake and exhaust ports each comprise rows of ports surrounding the cylinders. In the preferred implementation, the intake ports consist of two rows of ports (1161*a* and 1161*b* on the left cylinder and 1261*a* and 1261*b* on the right cylinder) which allows for improved scavenging, as described below. On the left cylinder 1100, the outer piston 1110 opens and closes intake ports and the inner piston 1120 opens and closes exhaust ports 1163. Fuel injection port 1162 is located near the center of the cylinder. On the right cylinder 1200, the inner piston 1220 opens and closes intake ports 1261*a* and 1261*b* and the outer piston opens and closes the exhaust ports. Again, fuel injection port 1262 is located near the center of the cylinder.

The preferred implementation utilizes two superchargers (1510, 1520), one for each cylinder. The superchargers are electric motor/generator assisted turbochargers. The use of separate superchargers for the two cylinders makes pulse turbocharging practical, as described below.

It may be observed in FIGS. 6 and 8 that the left and right cylinders (1100 and 1200, respectively) of the preferred embodiment have a slight vertical offset or misalignment with respect one another, with the left cylinder being somewhat higher than the right cylinder. Computer analysis indicates that this slight misalignment (on the order of 10 mm in the preferred embodiment) somewhat reduces overall friction losses in the engine. Computer analysis further shows that proper selection of this offset can introduce a small dynamic inbalance generally opposite in polarity to the residual imbalance of the engine, and thereby this offset can also serve to substantially cancel the residual imbalance of the engine.

2. Intake and Exhaust Port Timing and Crankshaft Parameters

Figure 9B:
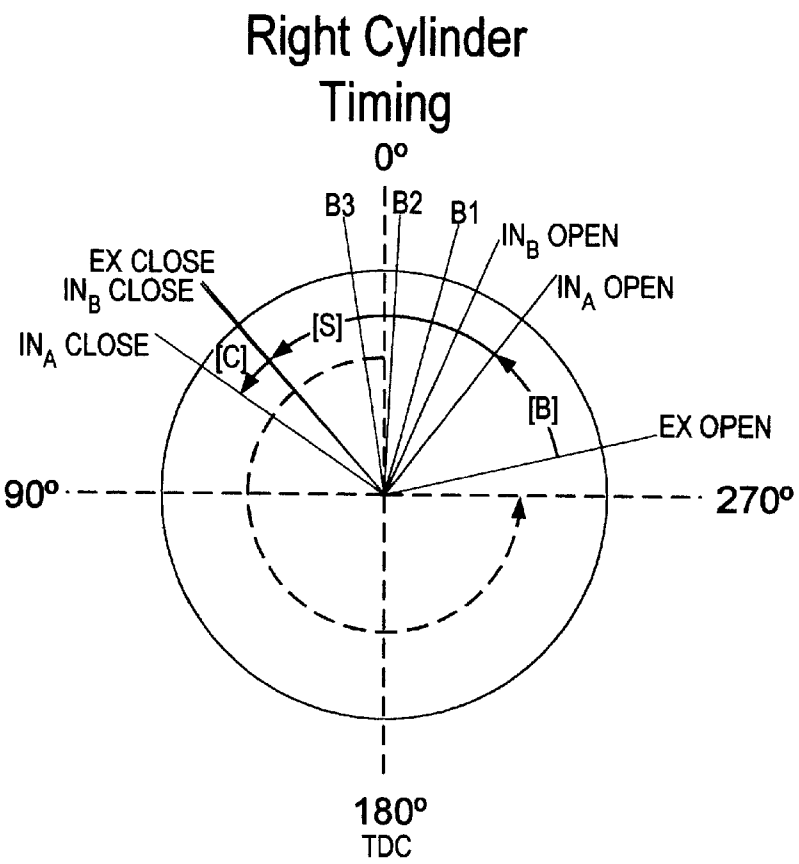
FIG. 9 illustrates the detailed timing of the preferred embodiment of the present invention, showing the opening and closing of the intake and exhaust ports for the two cylinders as a function of crankshaft angle.
Figure 9A:
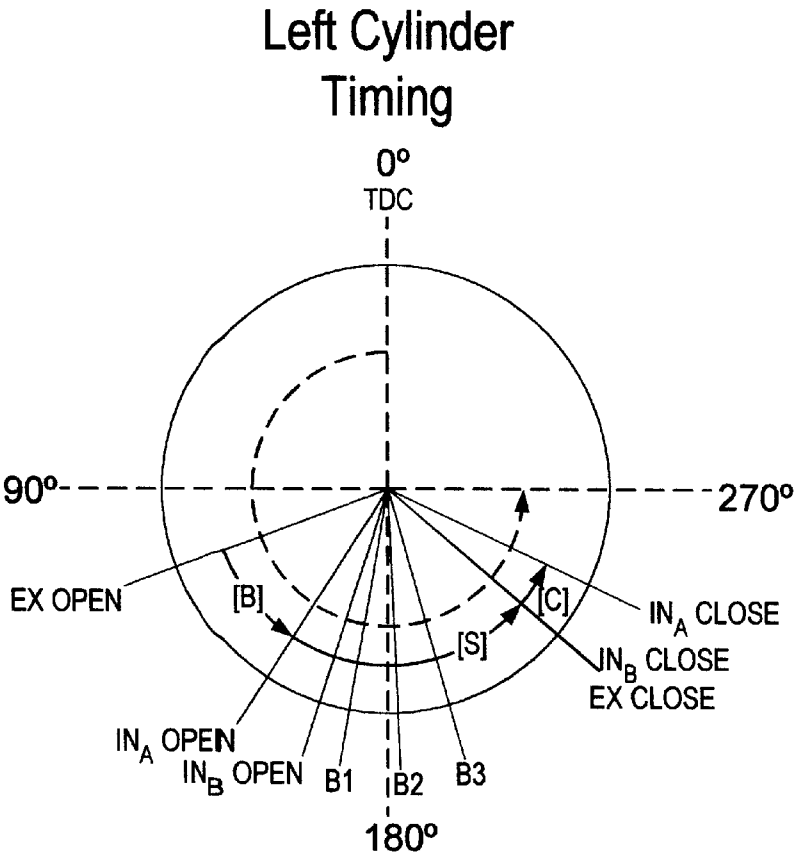

FIG. 9 as viewed in conduction with FIG. 8 illustrates the intake and exhaust port timing of the preferred embodiment of the invention. For purposes of illustration, a crankshaft angle of 0° is arbitrarily defined as top-dead-center (TDC) on the left cylinder. Note that TDC is here defined as the point at which the two pistons in the cylinder most closely approach one another; since the timing of one piston is advanced and the other is retarded, the two pistons will actually have a slight common velocity with respect to the cylinder at this point (towards the right in the illustration for both cylinders).

As explained above, the inboard piston in each cylinder is not attached to the corresponding connecting rod with a pin, but impinges on the concave cylindrical surface of the end of the rod through a crosshead slipper, giving the effect of a longer connecting rod (e.g., reduced lateral forces on the piston and therefore reduced friction).

For clarity, the engine is shown in FIG. 8 with the crankshaft at an angle of rotation of 270°, the same crankshaft angle depicted in FIG. 1. At this angle, the pistons in the left cylinder are converging, with all intake and exhaust ports closed, compressing the air between them. The right cylinder is in its power stroke, with the exhaust ports not yet open.

Timing for the left cylinder is illustrated in FIG. 9(*a*), and for the right cylinder in FIG. 9(*b*). Beginning at the position illustrated in FIG. 8 and proceeding through a complete cycle for the left cylinder, the timing events are as follows:

As the crankshaft approaches 0°, the gap between the inboard and outboard pistons narrows, and the air between the pistons is compressively heated. Near TDC (crankshaft angle 0°), the outer perimeters of the pistons come into close contact, creating a "squish" area that produces strong currents in the combustion chamber itself, as described below. At some point prior to TDC, fuel is injected into the combustion chamber through port 1162, and combustion initiates.

The power stroke extends beyond a crankshaft angle of 90°, with the gas between the inboard and outboard pistons expanding. At event EX OPEN, the inboard piston 1120 begins to uncover exhaust ports 1163. The kinetic energy of the expanding gases may be utilized during the period designated [B] (for "blowdown") for pulse turbocharging, as discussed below.

At $IN_A$ OPEN, the outboard piston 1110 begins to uncover the first row of intake or scavenging ports, 1161*a*. This first row of ports is arranged so that the air enters somewhat tangent to the cylinder, creating swirl within the cylinder to scavenge the bulk of the exhaust gases within the cylinder through the exhaust ports. Both these ports and the 1161*b* ports are angled towards the outboard end of the cylinder (in the preferred embodiment, approximately 23°) such that intake air is directed tangential to the torroidal squish band of the outboard piston. Scavenging is designated [S] in FIG. 9(*a*).

At $IN_B$ OPEN, the second row of intake or scavenging ports 1161*b* are uncovered. This row of ports is arranged such that the air is directed towards the center of the of the cylinder, rather than tangential around the edge of the cylinder. The incoming air entering through ports 1161*b* passes over the face of the outboard piston 1110 and is directed by the central peak of the piston through the center of the combustion chamber. This serves to scavenge the central vortex of exhaust gases created by the swirl of the first row of scavenging ports.

Since the timings of the two pistons are asynchronous, there is no point in the cycle strictly corresponding to what is normally termed bottom-dead-center (BDC). At point B1, the inboard piston reaches its maximum excursion and reverses direction; at point B2, both pistons are traveling in the same direction at the same speed (the opposite of the "TDC" defined above). At point B3, the outboard piston reaches its maximum excursion and reverses direction.

At EX CLOSE, the inboard piston 1120 covers the exhaust ports 1163. From event EX CLOSE until the outboard piston covers the first row of intake ports at $IN_A$ CLOSE, the cylinder may be charged with air under pressure using a turbocharger or supercharger, as described below. The period of charging is designated [C] in FIG. 9(*a*). Having the exhaust ports close before the intake ports provides the opportunity not only to supercharge the engine, but also in appropriate situations to restrict the amount of air entering the chamber. In low engine-load situations, for example, reducing the amount of air entering the chamber while correspondingly reducing the amount of fuel injected could improve mileage and reduce emissions. A turbocharger having an integral motor/generator would be suitable for this purpose, as described below.

The timing of the right cylinder, as shown in FIG. 9(*b*), is essentially the same as that of the left cylinder, but is 180° out of phase with the left cylinder and the functions of the inboard and outboard pistons are reversed.

3. Crankshaft Design

Figure 10:
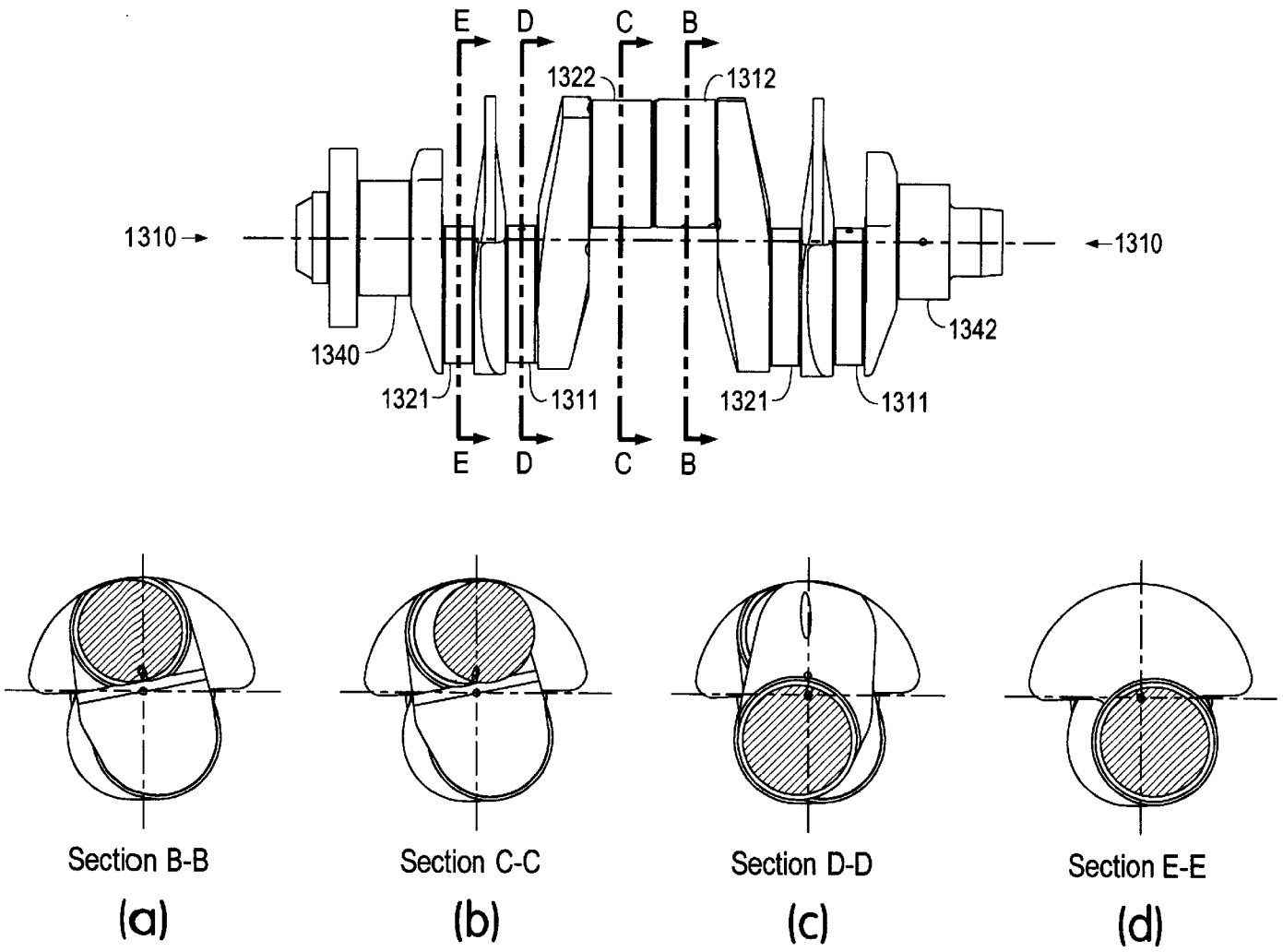
FIGS. 10 and 10(*a*)–10(*d*) are a side view of the crankshaft of the preferred embodiment with sectional views through the journals.

FIG. 10 further illustrates the crankshaft of the presently preferred implementation. Each of the four crankshaft eccentrics 1311, 1312, 1321, and 1322 are uniquely positioned with respect to the crankshaft rotational axis 1310. The eccentrics for the inner pistons (1312, 1322) are further from the crankshaft rotational axis than the eccentrics for the outer pistons (1311, 1321), resulting in greater travel for the inner pistons than for the outer pistons. The eccentrics for the inner left piston (1312) and the outer right piston (1321), the pistons which open and close the exhaust ports in the two cylinders, are angularly advanced, while the eccentrics for the outer left piston (1311) and inner right piston (1322) are angularly retarded, as shown in sectional views B—B, C—C, D—D and E—E.

Figure 11:
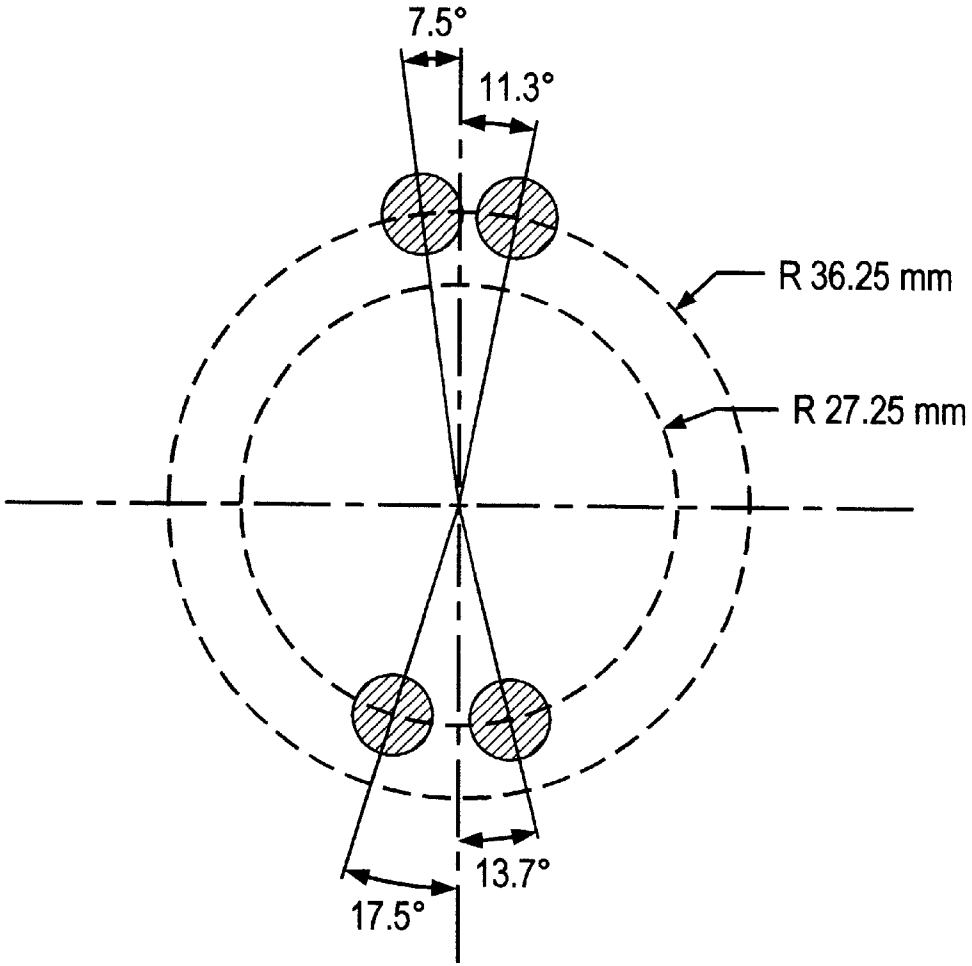
FIG. 11 is a schematic representation of the journal geometry, illustrating how engine balance and asymmetric timing are a function of the crankshaft design.

FIG. 11 shows the actual geometries of the crankshaft journals of the preferred implementation. The journals for the inner pistons have throws of 36.25 mm and the journals for the outer pistons have throws of 27.25 mm. The journals for the pistons controlling the exhaust ports of the left and right cylinders are advanced 7.5° and 13.7° respectively (again, crankshaft rotation is counterclockwise); the journals for the pistons controlling the intake ports for the left and right cylinders are retarded 17.5° and 11.3°, respectively. The differences in the angles for the left and right cylinders are the consequence of the engine asymmetries, including the 10 mm vertical offset of the two pistons, as described above.

The primary role of the crankshaft is to convert the reciprocating motion of the pistons, as conveyed through the pullrods and pushrods, into rotational motion. Unbalanced forces acting on a crankshaft result in increased friction between the crankshaft and its supporting bearings. The existence of unbalanced forces also complicates engine design, since the forces must somehow be mechanically transferred to the supporting structure of the engine, which must be sufficiently sturdy to accommodate the forces. In a standard four cylinder in-line engine, for example, the forces from all four pistons act in the same direction against the crankshaft, and literally tons of pressure must be transferred through the crankshaft main bearings to the engine structure. A typical four cylinder in-line engine will have five main bearings supporting the crankshaft.

The engine configuration of the present invention allows for a simpler crankshaft design, since the reactive forces of the inner and outer pistons in each cylinder substantially cancel. Referring to the left cylinder as illustrated in FIG. 4(*d*), it can be seen that since the compression and combustion forces acting on the two pistons will be substantially equal and opposite, the pullrod of the outer piston will pull against the crankshaft with substantially the same force with which the pushrod of the inner piston pushes. The result will be a turning moment on the crankshaft, with only very minor uncancelled side-to-side and up-and-down forces (due to the slightly different angles of the pullrods and pushrods, and the asymmetrical timing of the two pistons). The loads on the crankshaft main bearings are therefore very small, which eliminates the need for any center main bearings and results in much lower friction losses than in an in-line four cylinder engine of comparable performance.

4. Supercharging of the Preferred Embodiment

Figure 12B:
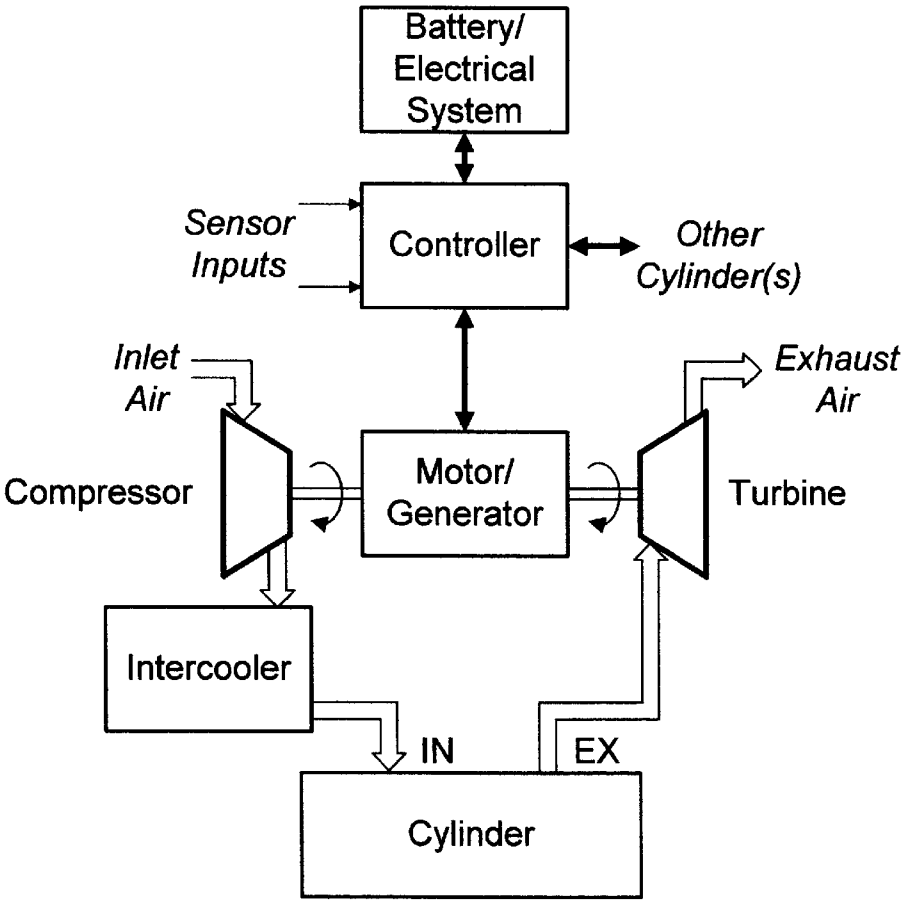
FIG. 12(*a*) schematically illustrates prior-art supercharging.
Figure 12A:
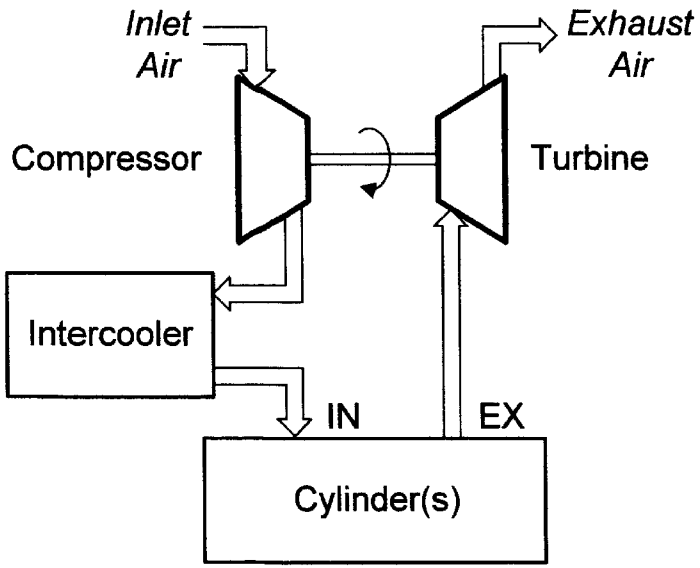
Prior Art Fig. 12(a)

The method of supercharging the preferred embodiment is depicted in FIG. 12, with FIG. 12(*a*) illustrating prior art turbocharging, and FIG. 12(*b*) illustrating the electric motor/generator assisted turbocharging of the preferred embodiment. The engine configuration of the present invention, with only two cylinders that are widely separated, together with independent intake and exhaust port timing, provides important opportunities for controlling the scavenging and intake air, and for recovering energy from the exhaust gases. In particular, with only two cylinders it becomes economically viable to provide a separate turbocharger for each cylinder, allowing for pulse turbocharging. Further, if the turbochargers incorporate electrical motor/generators, important performance advantages can be realized.

As often seen in the past, the success or failure of the 2-stroke design is determined primarily by its ability to scavenge. Optimal scavenging is needed over the entire engine map to achieve a perfect combustion, especially for controlling the EGR rate as required for $NO_x$ reduction.

4(*a*). Boost Pressure Control

To make a successful 2-stroke engine have equal or more power than its 4-stroke counterpart, it is necessary to use supercharged scavenge. Scavenge is dependent on the optimal pressure ratio between charge pressure and exhaust gas back pressure. The pressure ratio must primarily be adapted to engine rpm and must increase with increasing rpm. The pressure ratio also must be adaptable to load and transient operating conditions.

This can be achieved with an electrically assisted turbocharger with a permanent magnet brushless DC motor, enabling the usage of electronic control of turbo rpm and therefore of the boost pressure.

4(*b*). Pulse Turbocharging

The reciprocating internal combustion engine is inherently an unsteady pulsating flow device. Turbines can be designed to accept such an unsteady flow, but they operate more efficiently under steady flow conditions. In practice, two approaches for recovering a fraction of the available exhaust energy are commonly used: constant-pressure turbocharging and pulse turbocharging. In constant-pressure turbocharging, an exhaust manifold of sufficiently large volume to damp out the mass flow and pressure pulses is used so that the flow to the turbine is essentially steady. The disadvantage of this approach is that it does not make full use of the high kinetic energy of the gases leaving the exhaust port; the losses inherent in the mixing of this high-velocity gas with a large volume of low-velocity gas cannot be recovered. With pulse turbocharging, short small-cross-section pipes connect each exhaust port to the turbine so that much of the kinetic energy associated with the exhaust blowdown can be utilized. By suitably grouping the different cylinder exhaust ports so that the exhaust pulses are sequential and have minimum overlap, the flow unsteadiness can be held to an acceptable level. The turbine must be specifically designed for this pulsating flow to achieve adequate efficiencies. The combination of increased energy available at the turbine, with reasonable turbine efficiencies, results in the pulse system being more commonly used for larger diesels. For automotive engines, constant-pressure turbocharging is used.

Most turbocharged heavy-duty engines employ a divided exhaust manifold system connected to a divided volute turbine casing. For example, six-cylinder engines usually employ an exhaust manifold consisting of two branches; one branch covering the exhaust ports of cylinders 1, 2 and 3, and the other covering cylinders 4, 5 and 6. With the standard firing order of 1-5-3-6-2-4, it can be seen that the exhaust pulsations coming from the cylinders alternate from one branch to the other, allowing 120° of crank angle between each exhaust pulsation. The exhaust gas flow path remains divided from the manifold branch, through the divided casing turbine volute, up to the peripheral entrance to the turbine wheel. Thus, the divided manifold system prevents the blow-down pulse of each cylinder from interfering with the gas removal process from the cylinder that has fired previously.

Unfortunately, the high gas velocity that is generated when the exhaust valve opens is essentially lost as the pulse exits the exhaust port, enters the manifold, and encounters the large areas of the exhaust ports on its way to the turbine casing inlet. As a result, the turbocharger turbine casings are designed with a converging nozzle section in order to re-create the high velocity necessary to drive the turbine wheel. Since the exhaust gas must flow through a relatively small flow area at the throat of the nozzle section, a high back pressure is created in the manifold branch that increases engine pumping losses.

The engine of the present invention engine offers the possibility of utilizing the velocity generated by the cylinder blow-down process to drive the turbine directly. Since the exhaust gas will enter the turbine casing immediately after leaving the cylinder collection chamber, there will be no need to employ a nozzle section in the turbine casing. Additionally, since there will be one turbocharger per cylinder, the turbine casing will not need an internal division, thereby allowing full undivided admission of the exhaust gas to the turbine wheel periphery and maximizing turbine efficiency.

The preservation of blow-down exhaust gas velocity from cylinder to turbine wheel can be accomplished due to the unique design of the engine of the present invention and the utilization of one turbocharger per cylinder. The absence of a nozzle section in the turbine casing will result in a very low back pressure in the exhaust system when the pistons are exhausting the cylinder. In contrast to standard divided manifold systems, the differential pressure across the cylinder will be much greater with the engine of the present invention. This will result in a significant improvement in fuel consumption when compared with standard turbocharged two or four-cycle engines.

4(*c*) Uniflow Scavenge

Proper high efficiency cylinder scavenge requires a well-formed front between the intake air and the exhaust gas.

With the widely used loop scavenge or reverse flow scavenge, the present and future demands of light aircraft or automotive engines cannot be accomplished, because the exhaust gas and intake air mixes together. Of the possible uniflow scavenging methods, poppet exhaust valves, opposed pistons, or split single designs, that of the opposed pistons is the most promising because the port configuration allows the highest level of volumetric efficiency and the least mixing of exhaust gasses with the fresh intake air.

5. Pushrod and Pullrod Design

Approximately 50% of all friction losses in an engine come from lateral forces produced by the rotating connecting rod, acting on the piston, i.e., pushing the piston against the cylinder wall. A short connecting rod produces high lateral forces while a long connecting rod produces low lateral forces (an infinitely long connecting rod would produce no lateral forces on the piston at all, but it would also be infinitely large and infinitely heavy). It is desired to reduce these lateral forces and therefore friction losses without an increase in connecting rod size or weight.

Figure 13:
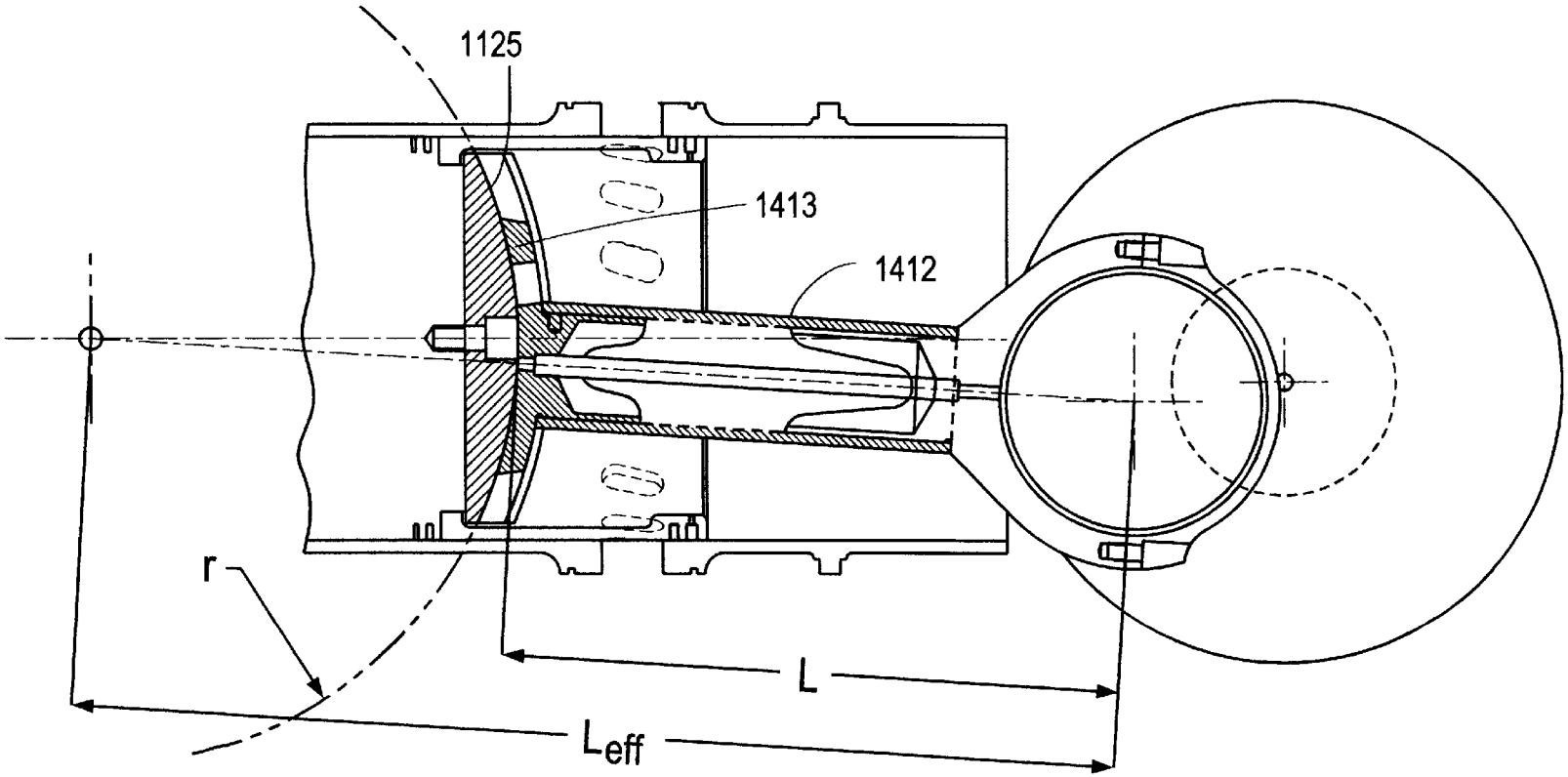
FIG. 13 is a detail illustration of the pushrods of the preferred embodiment.

The inner piston connecting rod on the engine of the present invention is subject only to compression loads that eliminates a need for a wrist pin. This is replaced by a concave radius of large diameter on which a sliding crosshead slipper impinges, and on which the connecting rod slides (FIG. 13). In order for this design to work, the forces at the end of the crosshead slipper must be greater than zero. This is the case as long as the coefficient of friction between the crosshead slipper and the slide of the connecting rod is lower than 0.45. With this configuration the theoretical rod length is increased by over 100 millimeters, thereby decreasing the lateral forces acting on the piston and the friction losses in the engine. Moreover, since $\lambda$ for the inboard piston is decreased, the free mass forces described above are also minimized.

Figure 14:
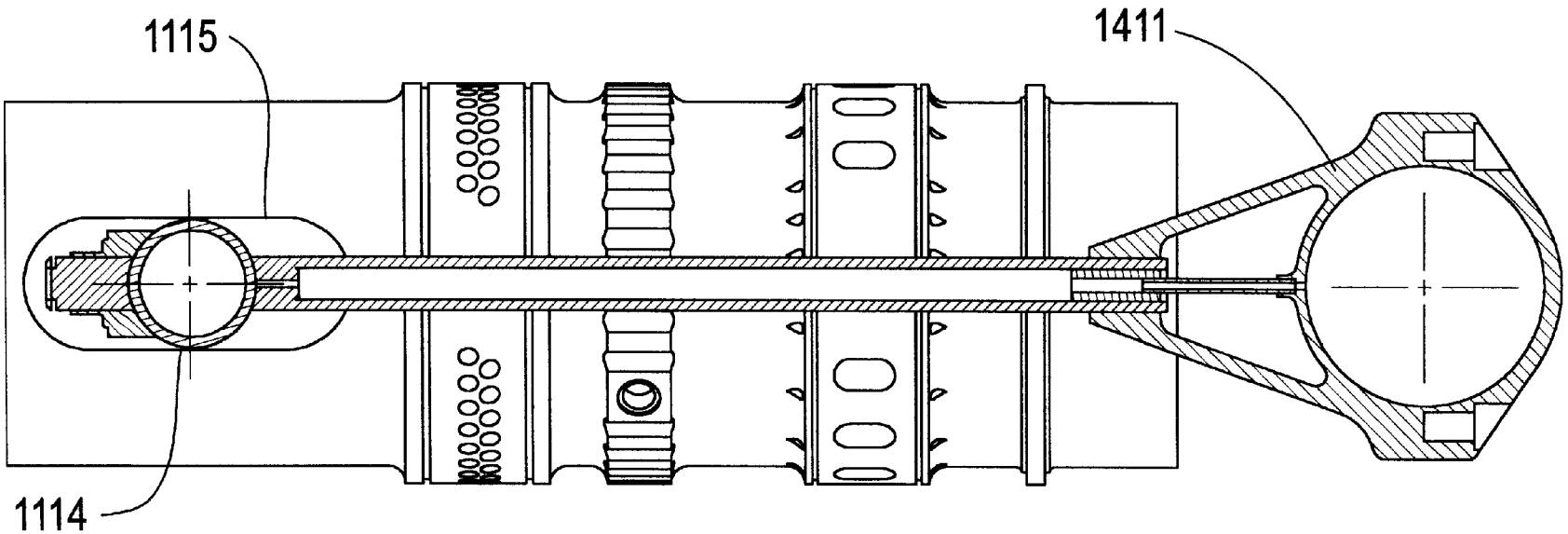
FIG. 14 is a detail illustration of the pullrods of the preferred embodiment.

The outer pistons transfer their reciprocating motion to the crankshaft via two connecting rods outside the cylinder (FIG. 14). These connecting rods are subject only to tension loads, and are therefor called pull rods. Here again there is a significant reduction in friction due to the long length of the pull rods. The pull rods are kept light by taking advantage of a constant tension no buckling load condition and designing them long and thin.

6. Combustion Chamber Design

The goals for the combustion system are:

1. Reduce the specific fuel consumption with an optimal thermodynamic process.

2. Reduce the pollutants in the exhaust gas by optimizing the reduction kinetics.

3. Increase power output.

4. Reduce the noise and the stresses in the power train.

For fuel consumption, the cyclic combustion process is superior to the continuous combustion process (gas turbine, Stirling engine, etc.) in an internal combustion engine because the working gas temperature can be much higher than the wall temperature. This leads to a much higher thermodynamic efficiency. Of internal cyclical combustion engines, the DI Diesel has the highest potential because it offers the opportunity for an optimal heat release by controlling the injection rate over crank angle. Creating the desired combustion process (which delivers the optimal heat release) requires the combination of the correct injection rate and swirl characteristic.

Figure 15A:
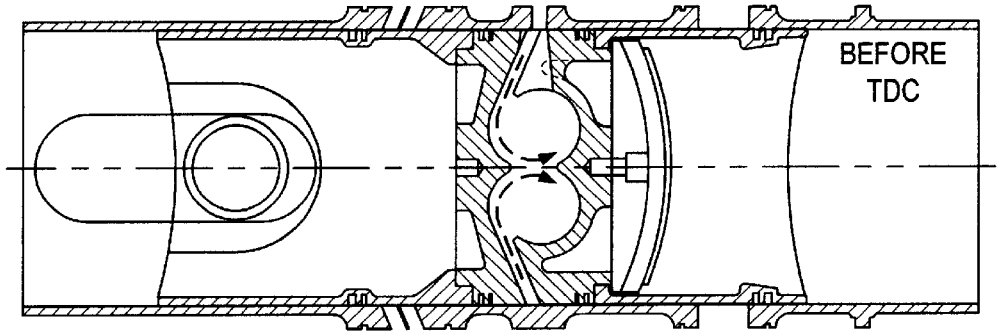
FIG. 15 is a detail illustration of the combustion chamber of the preferred embodiment.
Figure 15B:
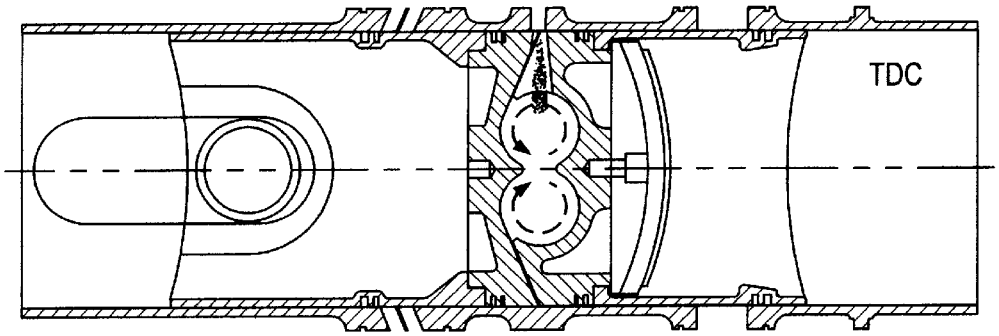
Figure 15C:
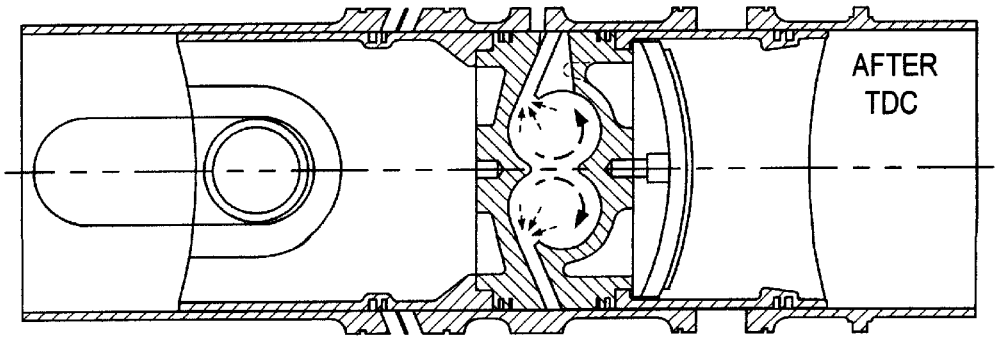

For reduction of pollutants, the engine of the present invention offers promising possibilities. Complete freedom exists for designing the shape of the combustion chamber because there are no valves in this engine. One example is shown in FIG. 15, which depicts the combustion chamber just prior to top dead center (FIG. 15(*a*)), at top dead center (FIG. 15(*b*)), and just after top dead center (FIG. 15(*c*)).

The combustion chamber is formed by the exhaust piston which has a torroidal shape matching the intake piston with a reverse profile. The pistons form a broad area squish band that creates a swirl of high intensity near top dead center. This conventional combustion system offered by the opposed piston design has the potential to improve the exhaust emissions, and also fuel consumption, power output and comfort.

Figure 16A:
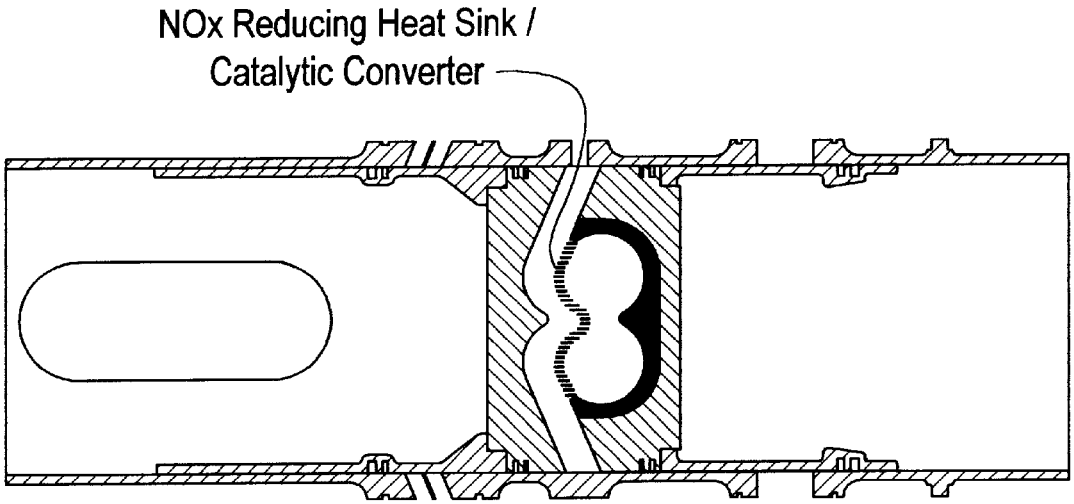
FIG. 16 illustrates the potential for alternative combustion chamber designs.
Figure 16B:
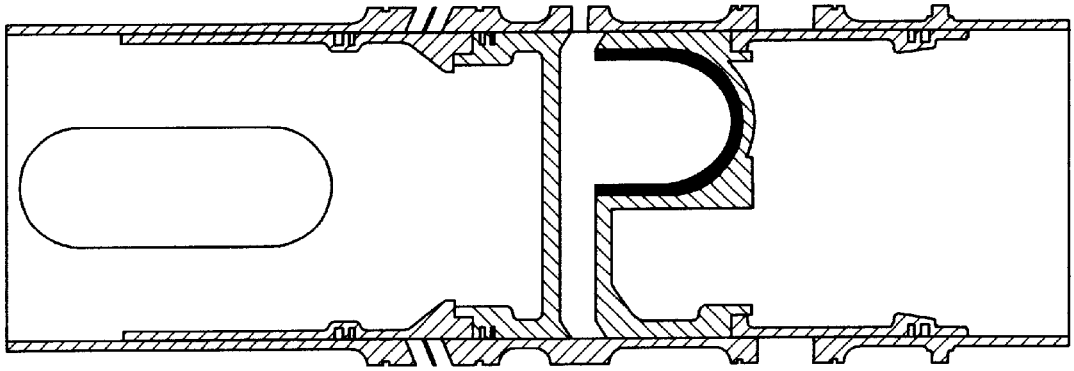

In addition to the features found in conventional combustion systems, the engine of the present invention provides the opportunity for unconventional new combustion systems, as shown in FIGS. 16(*a*) and 16(*b*). By splitting the cylinder volume into a combustion chamber, and the cylinder, it is possible to install a $NO_x$ reducing heat sink or a catalytic converter between the combustion chamber and the cylinder (ref. FIG. 16(*a*)). For reaction kinetic reasons, and, in order to maintain the optimum configuration for scavenging, the converter will be attached to the exhaust piston; fuel is injected by spraying directly into the combustion chamber. Such a combustion system might offer a breakthrough in extreme low emission combustion without sacrificing the fuel consumption, power output or comfort.

FIG. 16(*b*) represents a combustion chamber design having a spherical shape located very near the fuel injector which preserves the high pressure of the injected fuel and avoids the necessity of a narrow channel and the problems associated with a narrow channel.

CONCLUSION

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. An internal combustion engine comprising a single crankshaft and two opposed cylinders, each cylinder having two opposed pistons; wherein the single crankshaft has asymmetrically arranged journals, pushrods and pullrods for driving the journals from the pistons, each cylinder has air inlet ports and exhaust ports, the pistons in each cylinder operate to open its exhaust ports before its air intake ports and close them before its air intake ports close, and wherein the geometrical configurations and the masses of those parts are selected so as to minimize the dynamic imbalance of the engine during its operation.

2. An internal combustion engine comprising a single crankshaft having a plurality of journals, two opposed cylinders having their inner ends adjacent the crankshaft, each cylinder having inner and outer pistons reciprocably disposed therein and forming a combustion chamber therebetween, two pushrods each of which drivingly couples a respective inner piston to a correponding journal on the crankshaft, two pullrods each of which drivingly couples a respective outer piston to another corresponding journal on the crankshaft, and wherein the geometrical configurations and masses of those parts are selected so as to minimize the dynamic imbalance of the engine during its operation.

3. An internal combustion engine as in claim 2 wherein the product of the effective mass of each outer piston times the throw of the associated crankshaft journal is essentially equal to the product of the effective mass of each inner piston times the throw of its associated crankshaft journal, so that the dynamic imbalance due to the inner pistons substantially cancels the dynamic imbalance due to the outer pistons.

4. An internal combustion engine as in claim 2 wherein the single crankshaft has at least four journals, one for each piston, and the effective masses of the pistons and the throws of their associated crankshaft journals are selected such that the engine is essentially dynamically balanced.

5. An internal combustion engine as in claim 2 wherein each cylinder has air intake ports and exhaust ports formed near the respective ends of its combustion chamber, and fuel injection means communicating with its combustion chamber.

6. An internal combustion engine as in claim 2 including two pullrod for each cylinder, the two pullrod being on opposite sides of the cylinder, having inner ends that encircle an associated journal of the crankshaft, and having ends remote from the crankshaft that are pivotally coupled to the remote end of the respectively associated outer piston.

7. An internal combustion engine as in claim 2 wherein the pull rod and push rod journals for each cylinder are asymmetrically arranged so that the exhaust ports of the associated cylinder open before its air intake ports open and close before its air intake ports close.

8. An internal combustion engine as in claim 7 wherein the angular relation of the pull rod and push rod journals for each cylinder is about one hundred fifty-five degrees.

9. An internal combustion engine as in claim 7 wherein one cylinder has the air intake ports on its inner end adjacent the crankshaft while the other cylinder has its air intake ports on its outer end remote from the crankshaft.

10. An internal combustion engine as in claim 7 wherein the longitudinal axes of the cylinders are parallel but are offset in opposing directions from the axis of the crankshaft.

11. An internal combustion engine as in claim 7 which includes means for applying pressurized air to the intake ports of each cylinder.

12. An internal combustion engine as in claim 7 which further includes two superchargers, each being coupled to exhaust ports of an associated cylinder to receive blowdown gasses therefrom and to intake ports of that associated cylinder to apply pressurized air thereto.

13. An internal combustion engine as in claim 7 wherein each inner piston on its end remote from the combustion chamber has a smooth end face that is convexly curved in a plane perpendicular to the longitudinal axis of the crankshaft, and wherein an associated pushrod assembly includes a connecting rod coupled to one journal on the crankshaft and having a concavely shaped outer end surface that slidingly engages the curved end face of the inner piston; the effective length of each pushrod then including the radius of the convexly curved end face of the associated inner piston.

14. An internal combustion engine comprising a single crankshaft having at least four separate journals, two opposed cylinders having their inner ends adjacent the crankshaft, each cylinder also having inner and outer pistons reciprocably disposed therein to form a combustion chamber therebetween, each cylinder having air intake ports and exhaust ports formed near its respective ends and fuel injection means communicating with its combustion chamber, push rods drivingly coupling the respective inner pistons to respective journals on the crankshaft, pull rods drivingly coupling the respective outer pistons to other respective journals on the crankshaft, and wherein the masses and geometrical configurations of those parts are selected so as to minimize the dynamic imbalance of the engine during its operation.

15. An internal combustion engine as in claim 14 wherein the pull rod and push rod journals for each cylinder are asymmetrically arranged so that the exhaust ports of the associated cylinder open before its air intake ports open, and close before its air intake ports close.

16. An internal combustion engine as in claim 15 wherein one cylinder has the air intake ports on its inner end adjacent the crankshaft while the other cylinder has its air intake ports on its outer end remote from the crankshaft.

17. An internal combustion engine as in claim 15 wherein the angular relation of the pull rod and push rod journals for each cylinder is about one hundred fifty-five degrees.

18. An internal combustion engine as in claim 16 wherein the longitudinal axes of the cylinders are parallel but not coaxial.

19. An internal combustion engine as in claim 15 wherein each inner piston on its end remote from the combustion chamber has a smooth end face that is convexly curved in a plane perpendicular to the longitudinal axis of the crankshaft, and wherein an associated pushrod assembly includes a connecting rod coupled to one journal on the crankshaft and having a concavely shaped outer end surface that slidingly engages the curved end face of the inner piston.

20. An internal combustion engine as in claim 15 wherein the product of the effective mass of each outer piston times the throw of the associated crankshaft journal is essentially equal to the product of the effective mass of each inner piston times the throw of its associated crankshaft journal.

21. An internal combustion engine as in claim 14 including two pullrods for each cylinder, the two pullrods being on opposite sides of the cylinder, having inner ends that encircle an associated journal on the crankshaft, and having ends remote from the crankshaft that are pivotally coupled to the remote end of the respective associated outer piston.

22. An opposed-piston, opposed-cylinder two-stroke internal combustion engine comprising:

1) A pair of opposed cylinders, each cylinder having two pistons reciprocably mounted therein, the two pistons in each cylinder forming a combustion chamber between them;
2) A single crankshaft located centrally between the two cylinders, the crankshaft having a plurality of journals;
3) Each cylinder further having
   a) an inner end and an outer end, the inner end of each cylinder being adjacent to the single crankshaft;
   b) a cylinder wall with intake ports and exhaust ports, with one of the pistons in each cylinder operable to cover and uncover the intake ports in the cylinder wall, and the other piston in each cylinder operable to cover and uncover the exhaust ports in the cylinder wall, the intake ports in one cylinder being located towards the inner end of the cylinder and the exhaust ports located towards the outer end of the cylinder, the intake ports in the other cylinder being located towards the outer end of the cylinder and the exhaust ports located towards the inner end of the cylinder;
   c) the cylinder walls further having one or more slots towards the outer end;
4) A pair of pushrods assemblies, one pushrod assembly coupling a pushing force from the innermost piston in each cylinder to a journal on the crankshaft;
5) A pair of lightweight pullrod assemblies, one pullrod assembly coupling a pulling force from the outermost piston in each cylinder to a different journal on the crankshaft, the pullrod assemblies communicating with the pistons through the slots in the cylinder walls; and
6) The crankshaft journals being angularly positioned such that the dynamic forces within the engine substantially balance.

23. The opposed-piston, opposed-cylinder two-stroke internal combustion engine of claim 22, wherein the crankshaft journals are further angularly positioned such that the timing of the pistons controlling the exhaust ports in each cylinder is advanced with respect the piston controlling the intake ports, and such that the exhaust ports close prior to the closing of the intake ports, such that the air pressure within the combustion chambers may be controlled independently of the exhaust port back pressure.

24. The opposed-piston, opposed-cylinder two-stroke internal combustion engine of claim 23, wherein the angular advancement of the pistons controlling the exhaust ports with respect to the pistons controlling the intake ports is approximately 25 degrees of crankshaft rotation.

25. The opposed-piston, opposed-cylinder two-stroke internal combustion engine of claim 22, further comprising direct injection of fuel into the combustion chambers formed between the two pistons of each cylinder.

26. The opposed-piston, opposed-cylinder two-stroke internal combustion engine of claim 22, further comprising compression ignition of the air/fuel mixture within each cylinder.

* * * * *